US006195015B1

(12) United States Patent
Jacobs et al.

(10) Patent No.: US 6,195,015 B1
(45) **Date of Patent: *Feb. 27, 2001**

(54) ELECTRONIC PARKING METER

(75) Inventors: James P. Jacobs, Phoenixville; Vincent G. Yost, Harleysville, both of PA (US)

(73) Assignee: Intelligent Devices, Inc., Harleysville, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/286,921

(22) Filed: Feb. 2, 1999

Related U.S. Application Data

(63) Continuation of application No. 08/684,368, filed on Jul. 19, 1996, now abandoned.

(51) Int. Cl.[7] ..... G08B 23/00

(52) U.S. Cl. ..... 340/693.9; 340/693.12; 340/932.2; 340/933

(58) Field of Search ..... 340/693.9, 693.12, 340/932.2, 933, 942, 943

(56) References Cited

U.S. PATENT DOCUMENTS

| | | | |
|---|---|---|---|
| 3,114,128 | 12/1963 | Ljungman et al. | 340/932.2 |
| 3,211,267 | 10/1965 | Bayha | 194/212 |
| 3,588,794 | 6/1971 | Francis | 367/95 |
| 3,774,112 | 11/1973 | Panico | 375/309 |
| 3,998,309 | 12/1976 | Mandas et al. | 194/203 |
| 3,999,372 | 12/1976 | Welch et al. | 368/6 |
| 4,043,117 | 8/1977 | Maresca et al. | 368/6 |
| 4,183,205 | 1/1980 | Kaiser | 368/90 |
| 4,249,648 | 2/1981 | Meyer | 194/212 |
| 4,356,903 | 11/1982 | Lemelson et al. | 194/217 |
| 4,460,080 | 7/1984 | Howard | 194/317 |
| 4,483,431 | 11/1984 | Pratt | 194/317 |
| 4,591,823 | 5/1986 | Horvat | 340/936 |
| 4,823,928 | 4/1989 | Speas | 194/217 |
| 4,825,425 | 4/1989 | Turner | 368/7 |
| 4,848,556 | 7/1989 | Shah et al. | 194/212 |
| 4,967,895 | 11/1990 | Speas | 194/200 |
| 5,060,777 | 10/1991 | Van Horn et al. | 194/317 |
| 5,062,518 | 11/1991 | Chitty et al. | 194/317 |
| 5,097,934 | 3/1992 | Quinlan, Jr. et al. | 194/200 |
| 5,103,957 | 4/1992 | Ng et al. | 194/217 |
| 5,119,916 | 6/1992 | Carmen et al. | 194/210 |
| 5,153,586 | 10/1992 | Fuller | 340/932.2 |
| 5,166,681 | 11/1992 | Bottesch et al. | 340/933 |
| 5,208,586 | 5/1993 | Friberg et al. | 340/932.2 |
| 5,259,491 | 11/1993 | Ward, II | 194/350 |

(List continued on next page.)

FOREIGN PATENT DOCUMENTS 2077475 12/1981 (GB) .

*Primary Examiner*—Jeffery A. Hofsass
*Assistant Examiner*—Sihong Huang
(74) *Attorney, Agent, or Firm*—Caesar, Rivise, Bernstein, Cohen & Pokotilow, Ltd.

(57) ABSTRACT

An electronic parking meter which is capable of detecting presence of a parked vehicle, keeping track of the amount of money, including both U.S. and foreign coinage, in the meter, gathering statistics on the parking space and the meter, alerting the parking authority of meters that are expired in connection with vehicles still parked, and zeroing the remaining time off of any meter once the parked vehicle departs.

5 Claims, 34 Drawing Sheets

U.S. PATENT DOCUMENTS

| | | | |
|---|---|---|---|
| 5,266,947 | 11/1993 | Fujiwara et al. | 340/932.2 |
| 5,321,241 | 6/1994 | Craine | 463/25 |
| 5,361,070 | 11/1994 | McEwan | 342/21 |
| 5,366,404 | 11/1994 | Jones | 453/2 |
| 5,407,049 | 4/1995 | Jacobs | 194/200 |
| 5,442,348 | 8/1995 | Mushell | 340/932.2 |
| 5,454,461 | 10/1995 | Jacobs | 194/200 |
| 5,479,173 | 12/1995 | Yoshioka et al. | 342/70 |
| 5,528,217 | 6/1996 | Adams | 340/435 |
| 5,570,771 | 11/1996 | Jacobs | 194/200 |
| 5,614,892 | 3/1997 | Ward, III et al. | 340/870.02 |
| 5,642,119 | 6/1997 | Jacobs | 342/69 |
| 5,648,906 | 7/1997 | Amirpanahi | 705/418 |
| 5,659,306 | 8/1997 | Bahar | 340/932.2 |
| 5,710,743 | 1/1998 | Dee et al. | 368/90 |
| 5,761,155 | 6/1998 | Eccardt et al. | 367/99 |
| 5,777,951 | 7/1998 | Mitschele et al. | 368/90 |

FIG.9
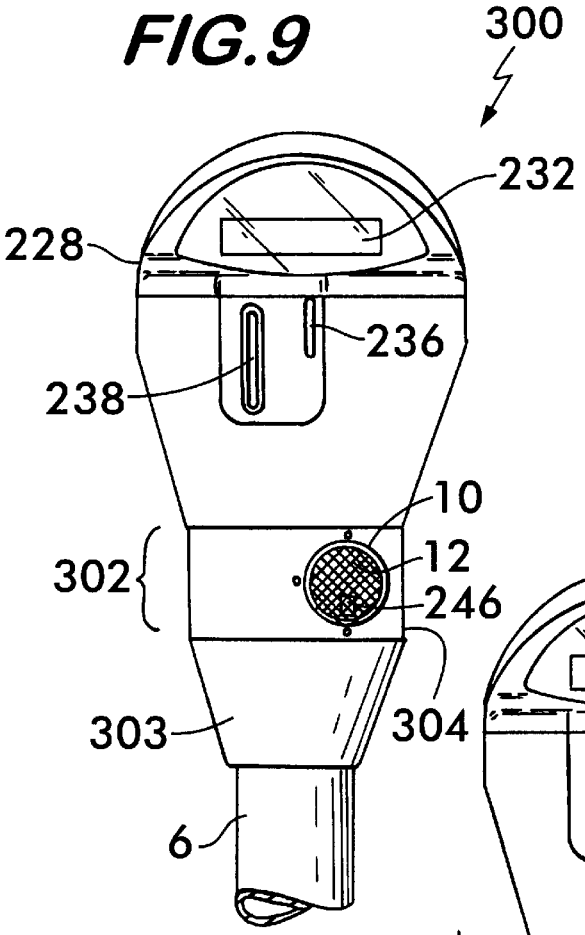
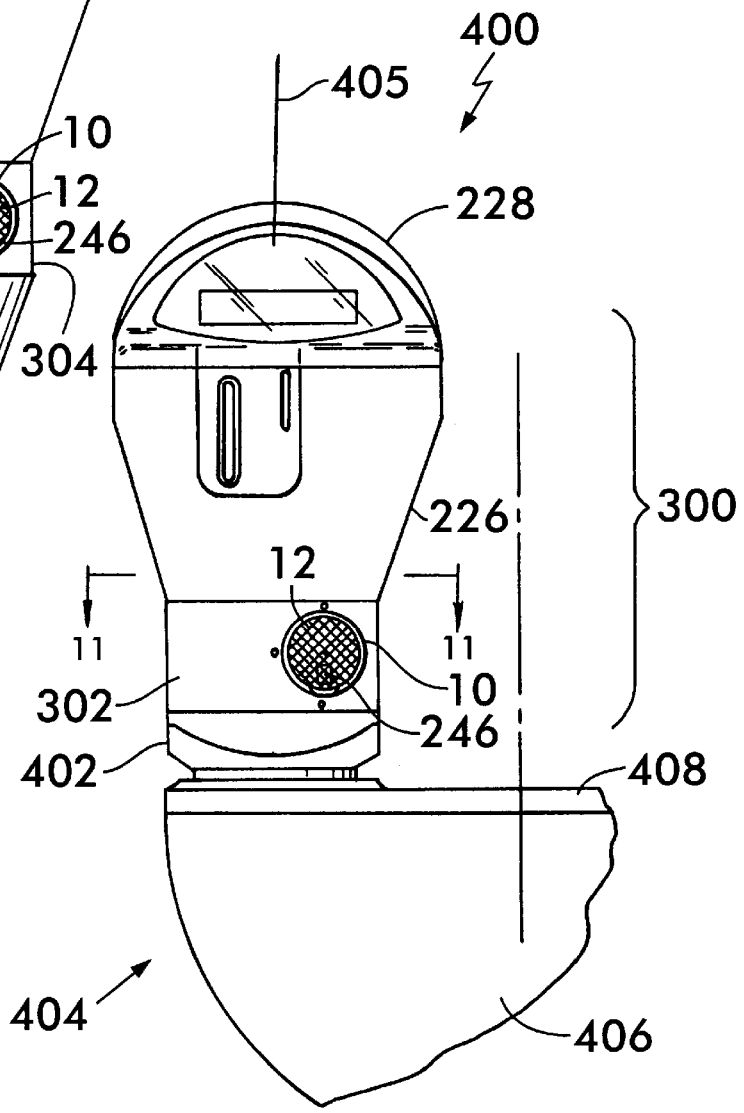
FIG.10

FIG.13
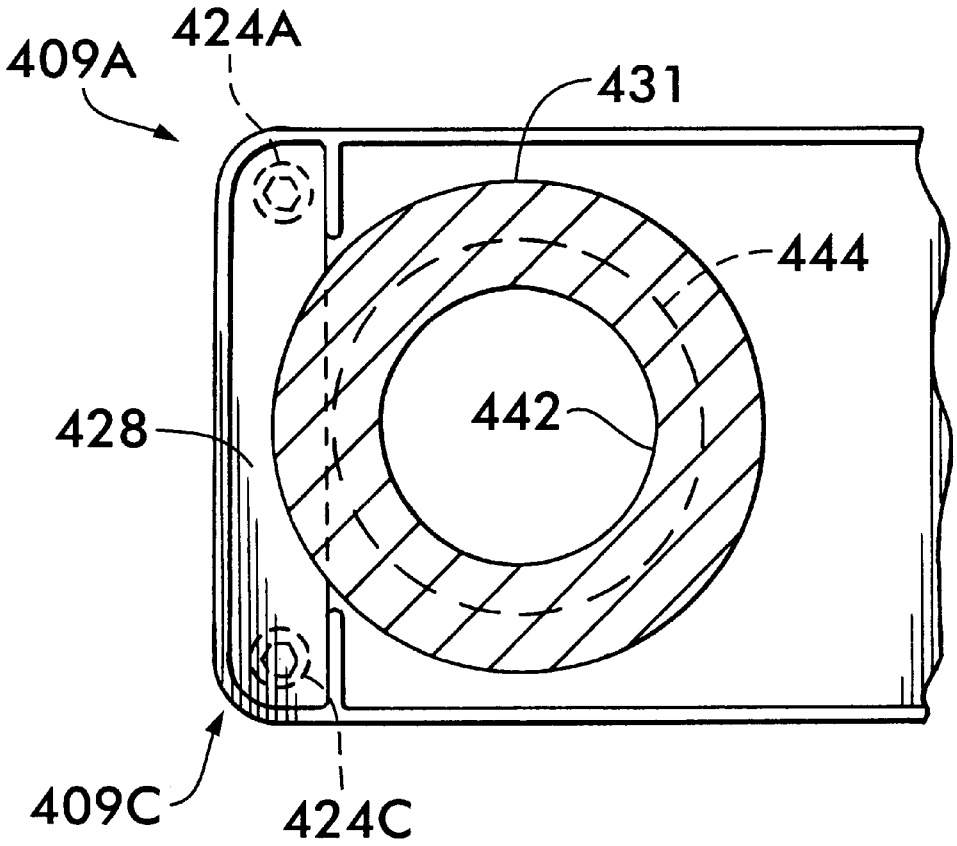
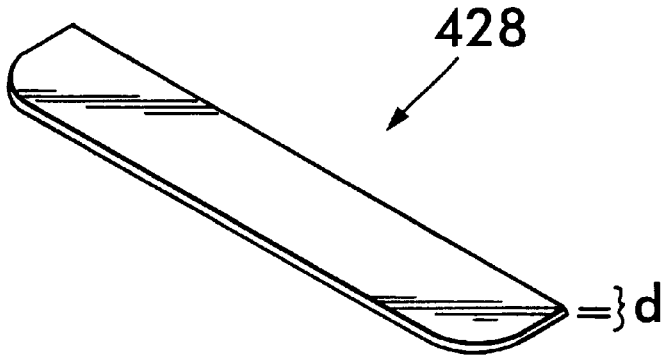
FIG.14

FIG.15
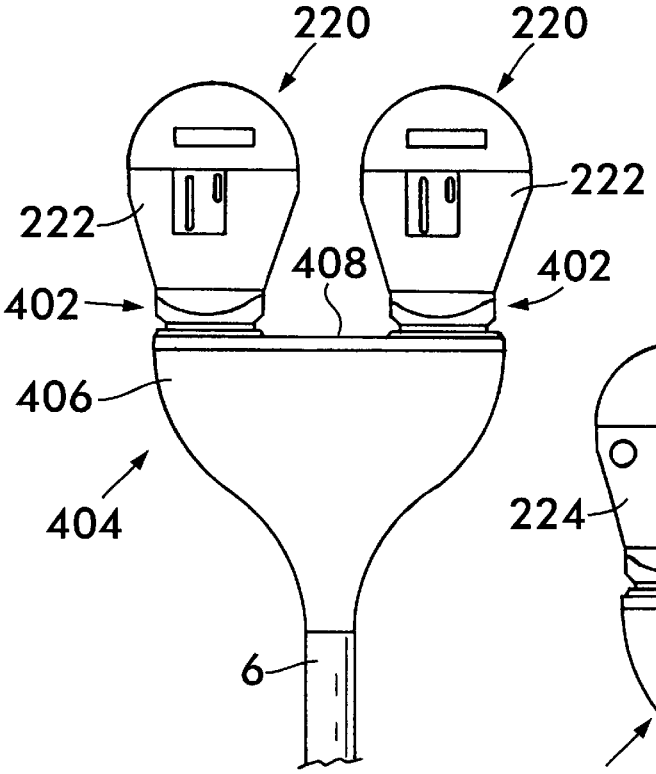
FIG.16
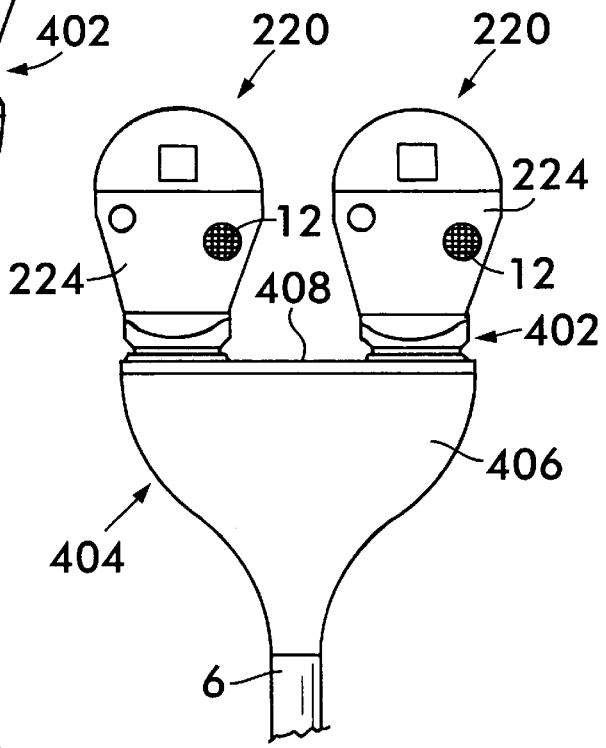
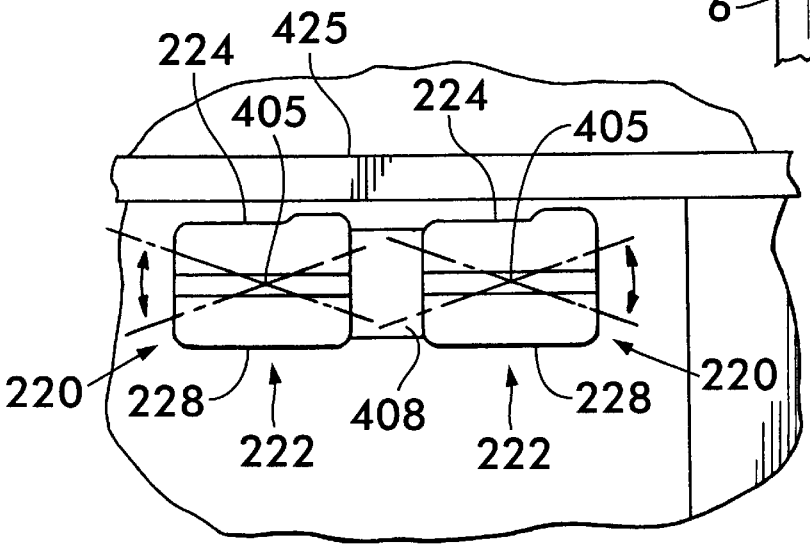
FIG.17

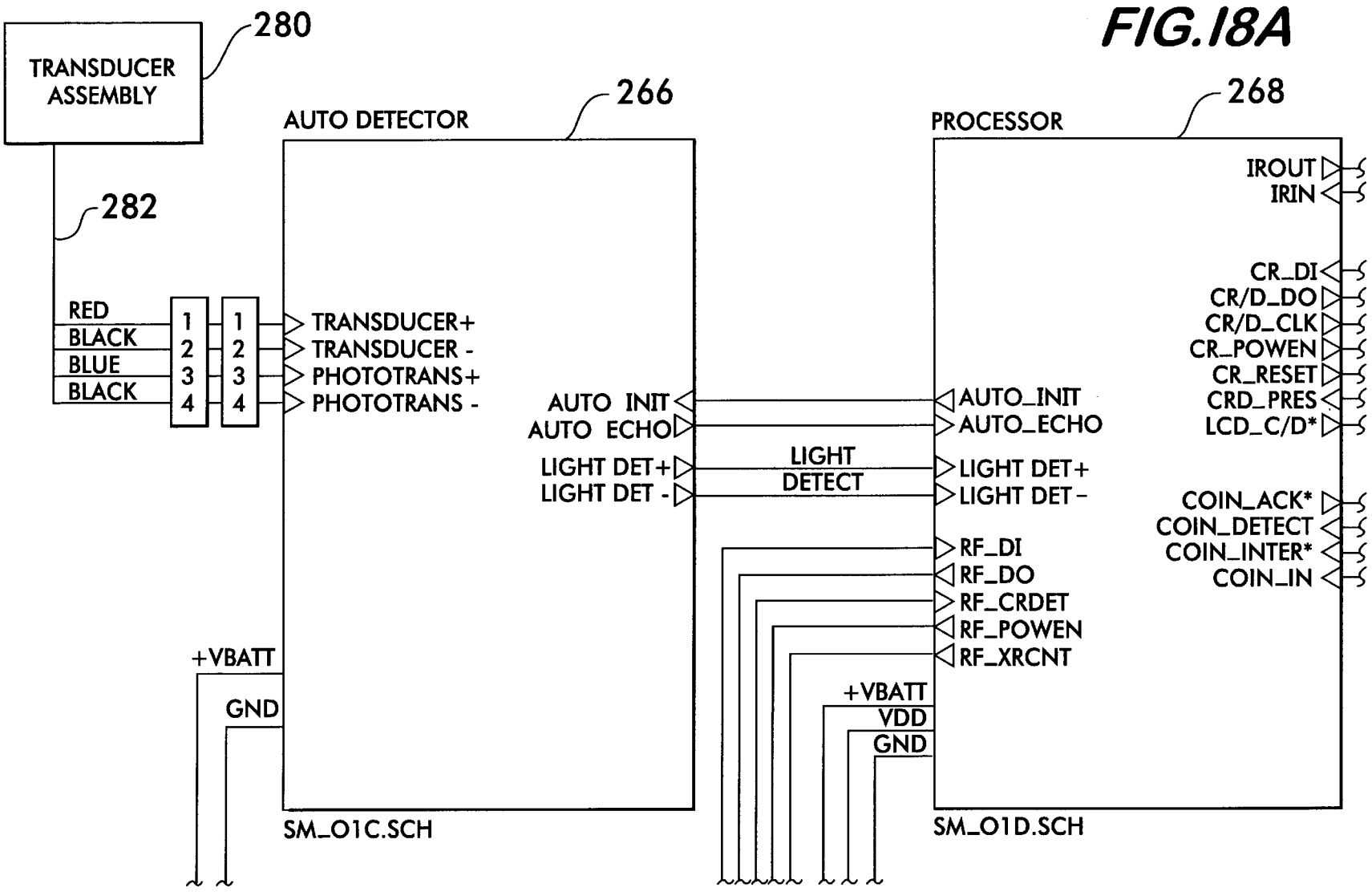
FIG.18A
268
PROCESSOR
IROUT
IRIN
CR_DI
CR/D_DO
CR/D_CLK
CR_POWEN
CR_RESET
CRD_PRES
LCD_C/D*
COIN_ACK*
COIN_DETECT
COIN_INTER*
COIN_IN
AUTO_INIT
AUTO_ECHO
LIGHT DET+
LIGHT DET -
RF_DI
RF_DO
RF_CRDET
RF_POWEN
RF_XRCNT
SM_O1D.SCH
+VBATT
VDD
GND
LIGHT
DETECT
266
AUTO DETECTOR
AUTO INIT
AUTO ECHO
LIGHT DET+
LIGHT DET -
TRANSDUCER+
TRANSDUCER -
PHOTOTRANS+
PHOTOTRANS -
SM_O1C.SCH
+VBATT
GND
280
TRANSDUCER ASSEMBLY
282
RED
BLACK
BLUE
BLACK
1
2
3
4

272
IR TRANSCEIVER
IROUT
IRIN
SM_O1F.SCH
252
COIN PROCESSOR
+VBATT
GND
270
COIN DETECTOR
COIN_ACK*
COIN_DETECT
COIN_INTER*
COIN IN
SM_O1E.SCH
+VBATT
GND

U11B
LMC6062IM
U10
LM35CZ
OUT
VDD
VBATT
D6
MMBD914
D7
MMBD914
R40
100K
0805TF
R36
1.0M
0805TF
R37
1.0M
0805TF
U11A
LCM5052IM
R34
1.0M
0805TF
R33
4.7M
0805TF
MMBT3906
Q11
BKL_POW
BKL_BATT
2N7002
Q12
R35
4.7K
0805TF
J5
CON4
MPC1

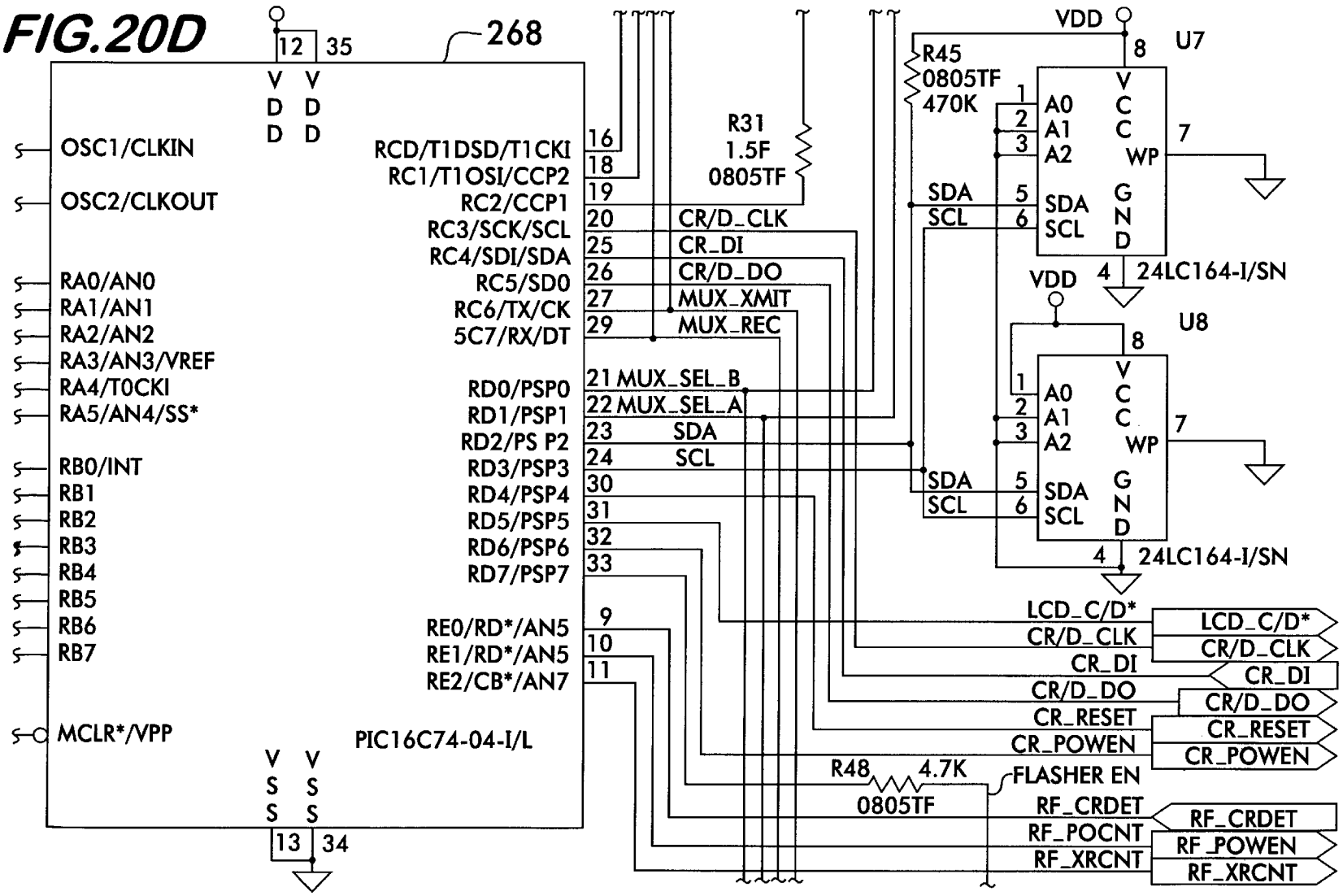
FIG.20D
268
U7
U8
24LC164-I/SN
VDD
A0
A1
A2
SDA
SCL
WP
VCC
GND
R45
0805TF
470K
R31
1.5F
0805TF
LCD_C/D*
CR/D_CLK
CR_DI
CR/D_DO
CR_RESET
CR_POWEN
RF_CRDET
RF_POWEN
RF_XRCNT
FLASHER EN
RF_POCNT
R48
4.7K
MUX_XMIT
MUX_REC
MUX_SEL_B
MUX_SEL_A
PIC16C74-04-I/L
OSC1/CLKIN
OSC2/CLKOUT
RA0/AN0
RA1/AN1
RA2/AN2
RA3/AN3/VREF
RA4/T0CKI
RA5/AN4/SS*
RB0/INT
RB1
RB2
RB3
RB4
RB5
RB6
RB7
MCLR*/VPP
RCD/T1DSD/T1CKI
RC1/T1OSI/CCP2
RC2/CCP1
RC3/SCK/SCL
RC4/SDI/SDA
RC5/SD0
RC6/TX/CK
5C7/RX/DT
RD0/PSP0
RD1/PSP1
RD2/PS P2
RD3/PSP3
RD4/PSP4
RD5/PSP5
RD6/PSP6
RD7/PSP7
RE0/RD*/AN5
RE1/RD*/AN5
RE2/CB*/AN7
VDD
VSS U13E
10
11
74AC14SM
VFLASH
U13F
12
13
74AC14SM
VFLASH
U5
RED
SHUTTER
STANDISH
DI0-3999
20
B
P
S
E
G
M
E
N
T
17
FLASHER_EN
CO N2
MPC1
CO N2
MPC1
01
02
+VBATT
GND
+VBATT
GND
+VBATT
R43
1.0M
0805TF
Q10
2N7002
R42
22.0M
0805TF
Q13
MMBT3906
VDD
VFLASH
VFLASH
U13C
74AC14 SM
VFLASH
U13A
74AC14 SM
VFLASH
U13D
74AC14 SM
VFLASH
U13B
74AC14 SM
100Hz
VFLASH
5.8M
1206TF
R41
CX9
0.01µF
0805/50
C20
1.000µF
0805/50
U14
S81250PG
VIN
VOUT
GND
VDD
C19
47µF
7343/16
TP2
TP1

AUTO_INIT
AUTO_INIT
VAD
R6
3.9K
0805TF
R7
470K
0805TF
U1A
74AC00 SM
VAD
R28
10K
0805TF
Q5
2N7002
C1
0.22µF
1206/50
R8
22M
1206TF
U2A
74AC14 SM
VAD
U2B
74AC14 SM
VAD
R5
470K
0805TF
Y1
50KHz
SM_XTL
C2
15pF
0805/50
C3
15pF
0805/50
VAD
R27
470K
0805TF
Q2
2N7002
U1B
74AC00SM
VAD
U2C
74AC14 SM
VAD
+VBATT
220K
0805TF
R/0
R11
100K
0805TF
VAD
Q9
MMBT3908
VREC
Q5
2N7002
R12
4.7K
0805TF

LIGHT DET
LIGHT DET
TO TRANSISISTOR
J2
1 + BLUE
2 - BLK
3 + RED
4 - BLK
CON4
MPC1
TO TRANSDUCER
VAD
R29
1.5M
1206TF
+VBATT
+VBATT
GND
GND
C10
0.1µF
0805/50
C15
100µF
4343/10
U5
S81250PG
VIN
GND
VOUT
VAD
C9
1.0µF
3216/16
TP4
D1
1EZ200D5
D2
1EZ200D5
C12
0.0022µF
1205/200
R25
22K
0805TF
D5
MMDBD914
T1
TN6384
COIL CRAFT
Q1
MMBT4401
D3
D4
MMDB914
MMDB914
C13
100µF
7343/10
+VBATT
R28
10K
0805TF
R30
820K
0805TF

ELECTRONIC PARKING METER

RELATED APPLICATIONS

This application is a continuation of application Ser. No. 08/684,368 filed on Jul. 19, 1996, now abandoned entitled ELECTRONIC PARKING METER which is assigned to the same Assignee, namely Intelligent Devices, Inc., of the present application and whose disclosure is incorporated by reference herein.

FIELD OF THE INVENTION

This invention relates generally to the field of parking meters and more particularly to electronic parking meters.

BACKGROUND OF THE INVENTION

Parking meters permit vehicles to be parked on streets for an allowable time determined by the number and denominations of coins which are placed in the parking meter. A clock mechanism in the parking meter runs down the allowable time until it reaches zero, and an overtime parking indication appears.

The coin receiving devices of the parking meters perform various tests to determine whether an acceptable coin has been inserted, and the denomination of the coin. Circuitry which tests for the presence of the ferrous material (i.e., slugs) includes Hall-effect sensors, and frequency shift metallic detectors. The denomination is determined by devices which measure the diameter of the coin such as infra-red emitting diodes and photodiodes, or which measure the weight of the coin using strain gauges, and the like.

Coin receiving mechanisms which use IR detectors, Hall-effect circuitry, magnetic fields and light sensing rays with microprocessors include U.S. Pat. No. 4,460,080 (Howard); U.S. Pat. No. 4,483,431 (Pratt); U.S. Pat. No. 4,249,648 (Meyer); U.S. Pat. No. 5,097,934 (Quinlan Jr.); U.S. Pat. No. 5,119,916 (Carmen et al.).

In recent years, electronic parking meters and systems have been developed which use microprocessors in conjunction with electronic displays, IR transceivers to communicate with auditors, and ultrasonic transceivers to determine the presence of vehicles at the parking meter. U.S. Pat. No. 4,967,895 (Speas) and U.S. Pat. No. 4,823,928 (Speas) disclose electronic parking meters which use microprocessors, electronic displays, IR transceivers, solar power and sonar range finders. In addition, British Publication No. 2077475 also discloses a low power electronic parking meter that operates using solar cells.

The sophisticated devices which use microprocessors, electronic displays and IR/ultrasonic transducers consume too much power to operate by non-rechargeable batteries alone. Thus, the Speas' patents disclose the use of solar power cells which charge capacitors or rechargeable batteries.

Various problems exist with the use of solar power sources including the use of parking meters in shady areas, or the use of parking meters during periods in which there is very little sunlight. This causes the rechargeable batteries to run down, and they require frequent replacement. Or, in the case of the use of capacitors, the lack of power causes the meter to become inoperative.

Low power coin sorters are disclosed in U.S. Pat. No. 4,848,556 (Shah et al.); U.S. Pat. No. 5,060,777 (Van Horn et al.).

Coin processing and related auditing data systems are shown in U.S. Pat. Nos. 5,259,491 (Ward II); U.S. Pat. No. 5,321,241 (Craine); U.S. Pat. No. 5,366,404 (Jones);

Other token/coin processing devices such as disclosed in U.S. Pat. No. 3,211,267 (Bayha) provides token validation using magnetics; U.S. Pat. No. 3,998,309 (Mandas et al.) discloses an apparatus to prevent coin stringing and U.S. Pat. No. 5,062,518 (Chitty et al.) discloses apparatus that detects coin denomination based on acoustic vibrations from the coins striking an internal surface.

Parking devices using wireless data transmission are disclosed in U.S. Pat. No. 4,356,903 (Lemelson et al.); U.S. Pat. No. 5,103,957 (Ng et al.); U.S. Pat. No. 5,153,586 (Fuller); U.S. Pat. No. 5,266,947 (Fujiwara et al.).

Furthermore, the electronic parking meters are not necessarily intelligent meters. That is, these meters use electronics but they do not respond to changing conditions. For example, none of the above devices resets the parking meter to an expired state should the vehicle leave before the allotted time has passed; instead, the parking meter provides "free" parking for the time remaining.

In U.S. Pat. No. 5,407,049 (Jacobs), U.S. Pat. No. 5,454,461 (Jacobs), and U.S. Pat. No. 5,570,771 all of which are assigned to the same Assignee of the present invention and all of whose disclosures are incorporated by reference herein, there is disclosed a low-powered electronic parking meter that utilizes, among other things, a sonar transducer to detect the presence of vehicles, an infra-red transceiver for communicating with parking authority personnel, and domestic coin detection, coin jam detection and slug detection.

However, there remains a need for an intelligent electronic parking meter that can accept foreign, as well as domestic currency, which can detect the presence or absence of a vehicle and which can wirelessly transmit parking meter-related data to a mobile transceiver or to a central location.

OBJECTS OF THE INVENTION

Accordingly, it is the general object of this invention to provide an apparatus which addresses the aforementioned needs.

It is a further object of this invention to provide an an electronic parking meter that can accept foreign coinage, as well as United States coinage.

It is yet another object of this invention to provide an electronic parking meter that can accept payment from a pre-paid card or a smart card.

It is a further object of this invention to provide an electronic parking meter that can detect the presence or absence of a vehicle.

It is a further object of this invention to provide an electronic parking meter that can transmit parking meter related data to a mobile transceiver or to a central facility.

It is a further object of this invention to provide an electronic parking meter that operates at low power.

It is a further object of this invention to provide an electronic parking meter that can reset itself whenever a vehicle leaves the corresponding parking space before the allotted time passes.

It is yet another object of this invention to provide an electronic parking meter that provides an adjustable grace period to a patron to allow the patron to add funds to the meter before an expired condition occurs making the patron liable for a parking ticket.

It is yet another object of this invention to provide an electronic parking meter having an easily-visible indicator, from both the street side as well as from the sidewalk side, to a parking authority agent that the meter is an expired condition.

It is another object of this invention to overcome the problem of someone blocking or diverting the meter signal that detects the presence or absence of the vehicle.

It is another object of this invention to provide an electronic parking meter that continuously displays the allotted time remaining in hours, minutes and seconds.

It is another object of this invention to provide an electronic parking meter that displays the amount of time beyond the expiration period that the patron has been unlawfully parked.

It is another object of the present invention to provide an electronic parking meter that can either enforce a maximum parking time limit or can permit an unlimited coin/payment feed.

It is another object of the present invention to provide an electronic parking meter that permits an adjustable minutes/coin setting.

It is another object of the present invention to provide an electronic parking meter that permits an adjustable meter-active time and meter-inactive time.

It is another object of this invention to reduce the number of times that a parking authority agent must travel to each parking meter to determine the expired status of the meter and/or to collect parking meter-related data from the meter.

It is another object of this invention to reduce the time that a parking authority agent must remain at any one meter in order to collect the deposited money.

It is still yet another object of this invention to provide a sonar transducer spacer that permits the sonar transducer, which is used to detect a vehicle, to be separate from the parking meter housing.

It is still even another object of this invention to provide a rotator adaptor device that permits an electronic parking meter, as well as any conventional parking meter, to be adjustably rotated about a vertical axis by parking meter personnel only while and being tamper proof.

SUMMARY OF THE INVENTION

These and other objects of the instant invention are achieved by providing an electronic parking meter for use at a corresponding curb side parking space whereby the electronic parking meter comprises a stanchion and a housing coupled to the stanchion. The housing has a first side with a coin slot and a second opposite side. The electronic parking meter further comprises a cover coupled to the housing. The electronic meter also includes a modular assembly contained within the housing which comprises a coin processor for receiving and processing either United States coinage or foreign coinage inserted into said coin slot for permitting the lawful use of the curb side parking space by a vehicle.

DESCRIPTION OF THE DRAWINGS

Other objects and many of the attendant advantages of this invention will be readily appreciated as the same becomes better understood by reference to the following detailed description when considered in connection with the accompanying drawings wherein:

FIG. 9 is another embodiment of the present invention which includes a sensor spacer;

FIG. 10 shows the embodiment of FIG. 9 coupled to a double-headed meter platform using a rotator adaptor for use in a parking lot;

FIG. 13 is a view of the rotator adaptor taken along line 13—13 of FIG. 12;

FIG. 14 is an isometric view of the tamper-proof member;

FIG. 15 is sidewalk-side view of the present invention installed on a double-headed meter platform using a rotator adaptor for use in street-side parking;

FIG. 16 is the street side view of the embodiment of FIG. 15;

FIG. 17 is a top view of the double-headed meter depicting the rotation angle permitted by the rotator adaptor;

FIGS. 18A–18D constitute a block diagram of the electronics of the electronic parking meter;

FIG. 19 is a figure layout for FIGS. 20A–20F;

FIGS. 20A–20F constitute an electrical schematic of the microprocessor and the liquid crystal display;

DESCRIPTION OF THE PREFERRED EMBODIMENT OF THE INVENTION

Figure 1:
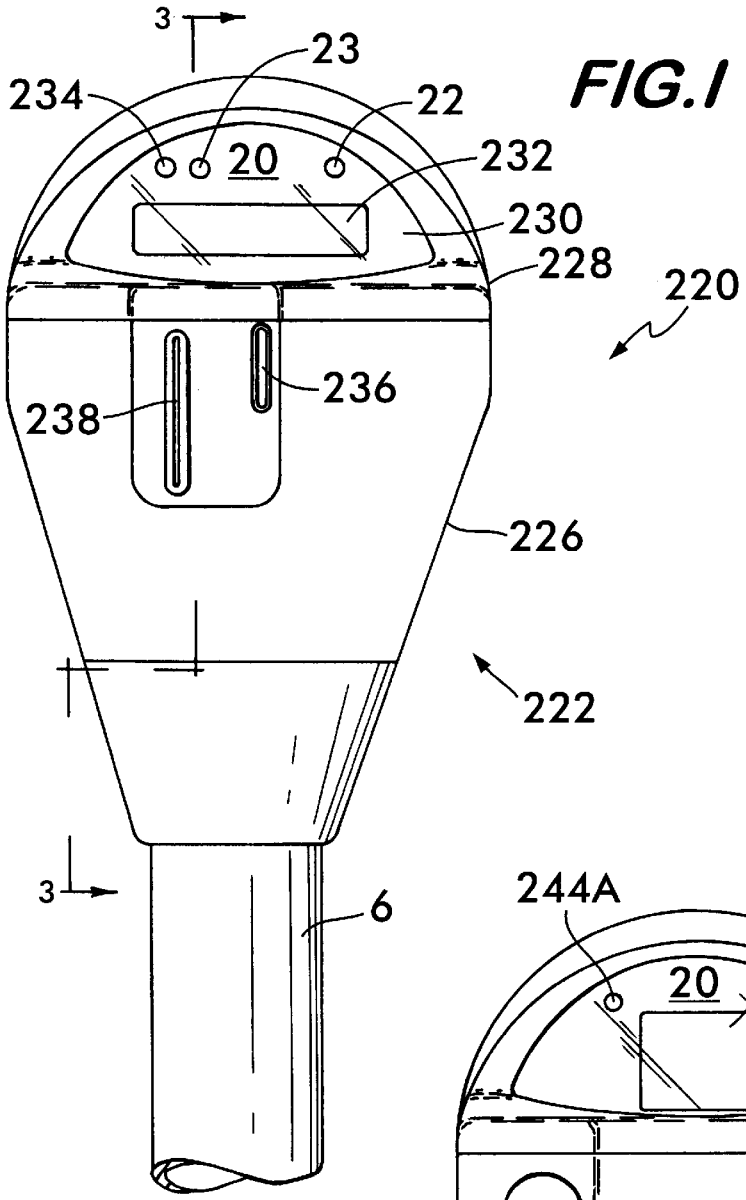
FIG. 1 is a sidewalk-side elevation view of the electronic parking meter.

Referring now in greater detail to the various figures of the drawing wherein like reference characters refer to like parts, an electronic parking meter constructed in accordance with the present invention is shown generally at 220 in FIG. 1.

The electronic parking meter 220 comprises a side 222 (FIG. 1) that faces the sidewalk (i.e., a direction away from the street), hereinafter known as the "sidewalk-side" of the meter 220; similarly, the meter 220 comprises a side 224 (FIG. 2) that faces the street (not shown), hereinafter known as the "street-side" of the meter 220.

The electronic parking meter comprises a housing 226 which is mounted on a stanchion 6. The meter 220 also comprises a cover portion 228 which includes a first window 230 on the sidewalk side 222 for viewing an internal electronic LCD, 8-character display 232. This display 232 displays the time and information concerning the operation and status of the electronic parking meter 220. This display 232 is mounted on a printed circuit board (PCB) 20 which holds the electrical and electronic components (hereinafter the "electronics") of the meter 220. The board has transmit/receive openings 22 and 23 behind which is mounted an IR transceiver for receiving information from, and conveying information to, parking authority enforcement and auditor personnel, as will be explained in detail later. A warning LED 234 is also located on the PCB 20 and is visible through the window 230; this LED 234 flashes whenever the display 232 indicates an "EXPIRED" indication, as will be discussed later. Finally, a coin insertion hole 236 as well as a payment card insertion hole 238 are included on the sidewalk side 222.

Figure 2:
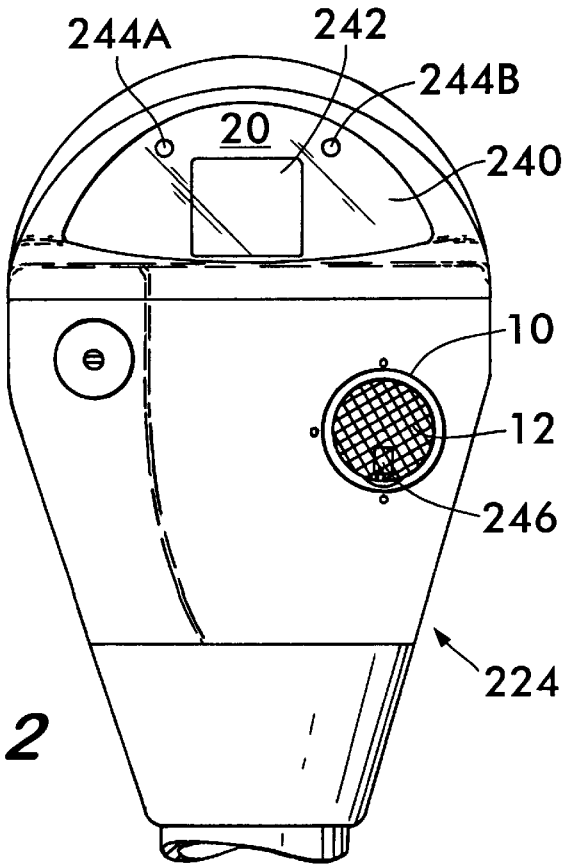
FIG. 2 is a street-side elevation view of the electronic parking meter.

As shown in FIG. 2, on the street side 224 of the meter 220 there is a second window 240 on the street side for viewing another internal electronic LCD display 242 which flashes whenever the meter 220 is in an EXPIRED state. In addition, there are two warning LEDs 244A and 244B located on the PCB 20 and visible through the second window 240. These two LEDs 244A and 244B flash simultaneously when the display 242 indicates an "EXPIRED" indication, thereby alerting any parking authority agent, viewing the street side 224 of the meter 220, that the meter 220 is expired. Furthermore, should the meter 220 become faulty these LEDs 244A and 244B flash alternately (like a "railroad warning") to alert the parking authority agent that the meter 220 is in a fault condition.

Figure 3:
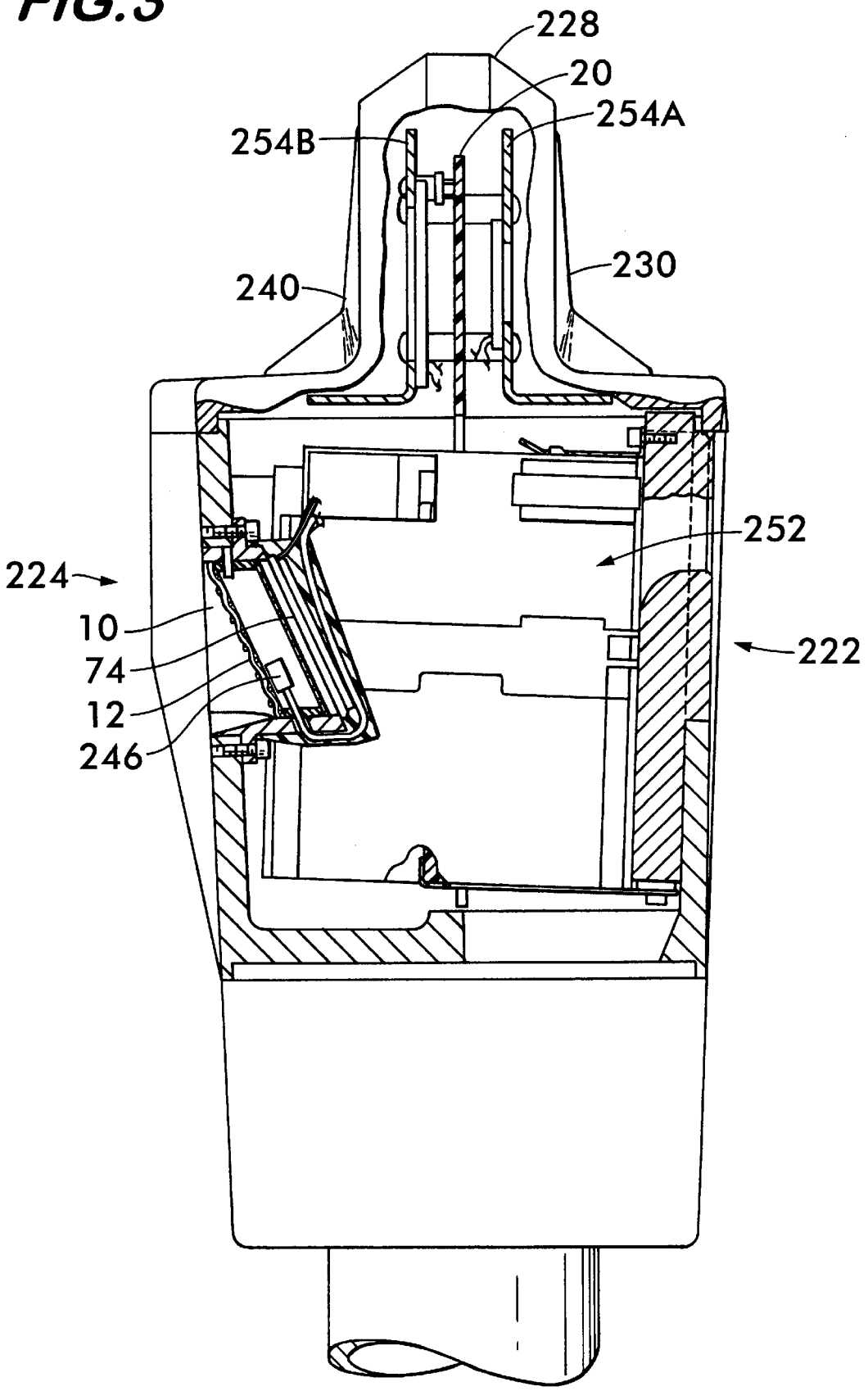
FIG. 3 is a side view, partially in section, of the parking meter taken along the lines 3—3 of FIG. 1.

The street side 224 of the meter also includes an opening 10 covered by a protective mesh 12. As will be discussed later, a sonar transducer 74 (FIG. 3) is mounted behind the protective mesh 12 to detect the presence of vehicles at the parking meter location. In addition, as can be seen in FIG. 2, a phototransistor 246 is mounted just behind the mesh 12 for monitoring the brightness level adjacent the meter 220, as will also be discussed in detail later.

Figure 6:
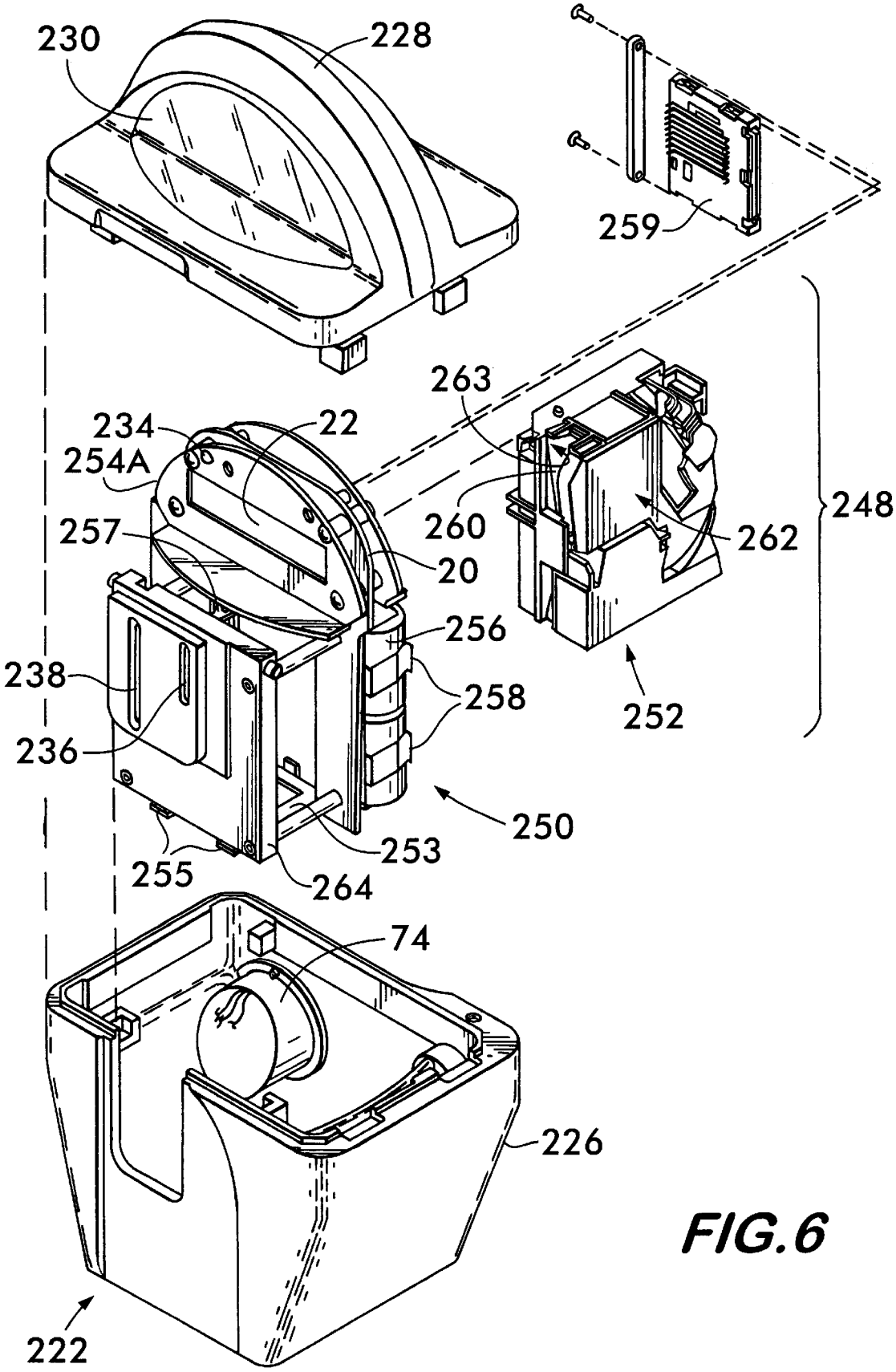
FIG. 6 is an exploded isometric view of the present invention.

As shown in FIG. 6, with the cover portion 228 removed, a modular assembly 248 can be removed from the housing 226. The modular assembly 248 comprises a PCB subassembly 250 and a coin handling subassembly 252. The coin handling subassembly 252 is releasably secured within the PCB subassembly 250. The PCB subassembly 250 comprises PCB 20, LCD support plates 254A and 254B, a coin/card plate 264, which contains the coin insertion hole 236 and payment card insertion hole 238. In addition, two lithium batteries 256A and 256B, for powering the meter 220, are secured to the PCB 20 via a battery bracket 258. Finally, a payment card connector 259 is coupled to the PCB subassembly 250 and is disposed to receives the payment card that is inserted into the payment card insertion hole 238.

Figure 4:
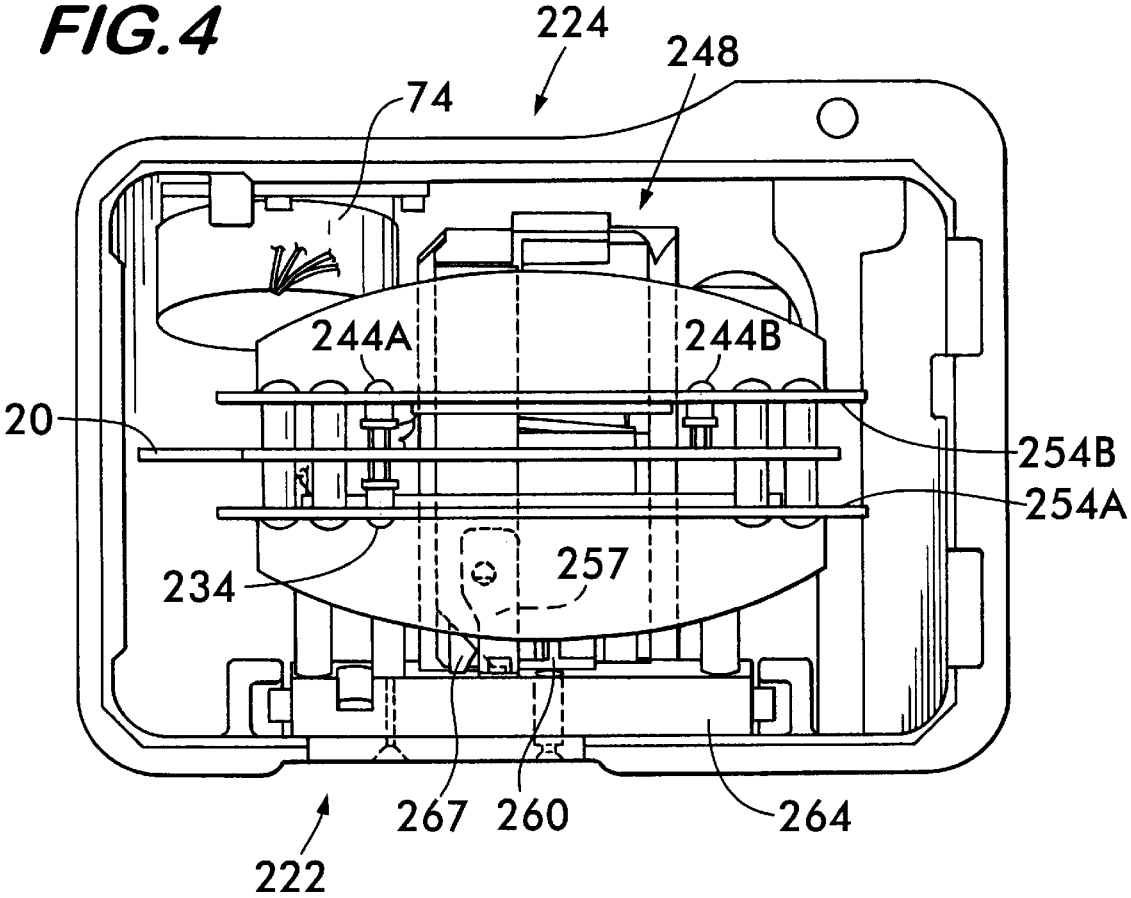
FIG. 4 is a top view of the parking meter with the cover removed, showing the modular assembly.

The coin handling subassembly 252 comprises a U.S. coinage/foreign coinage coin processor (e.g., a CashFlow® 330 Acceptor manufactured by Mars Electronics International of West Chester, Pa.) which is releasably secured within the PCB subassembly 250 via a support bracket 253, a pair of sheet metal screws 255 and a catch member 257. When the modular assembly 248 is installed in the housing 226 (FIG. 4), the coin handling subassembly 252 is disposed to receive the passage of a coin (not shown) through the coin insertion hole 236 and down into the coin processor 252 through a coin chute 260 (FIG. 7) within the coin processor 252 that is defined by an upper compartment 262 and a sidewall 263. Hereinafter the coin handling subassembly 252 is referred to as the coin processor 252.

Figure 5:
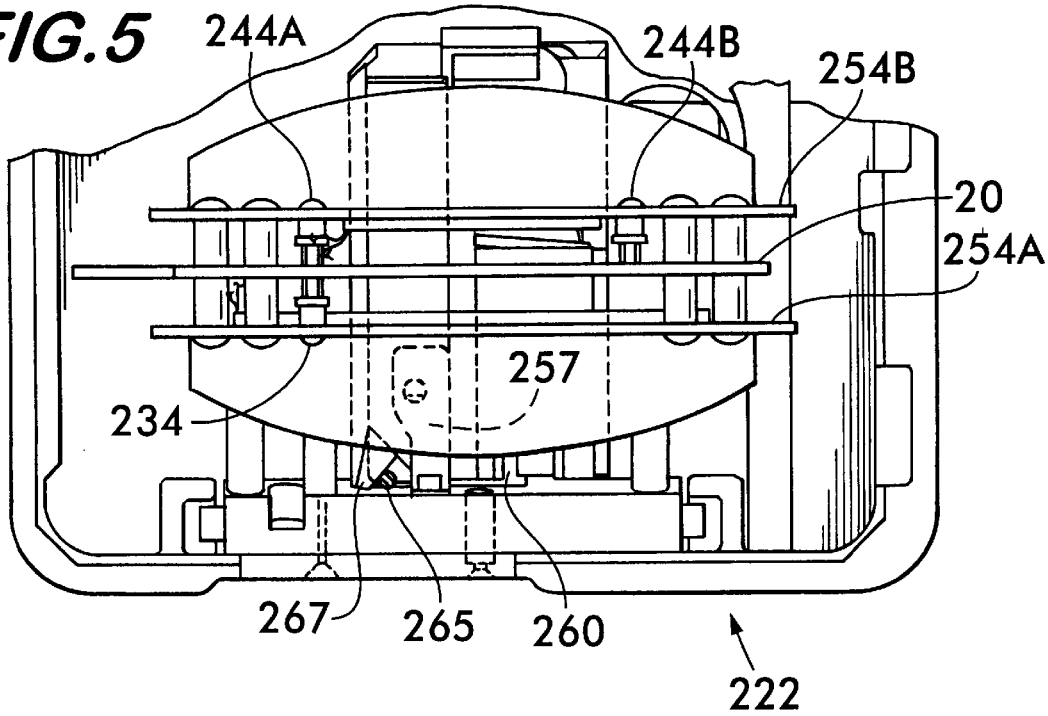
FIG. 5 is a top view of the parking meter with the cover removed, showing the modular assembly and the insertion of an instrument to clear a coin jam.
Figure 8:
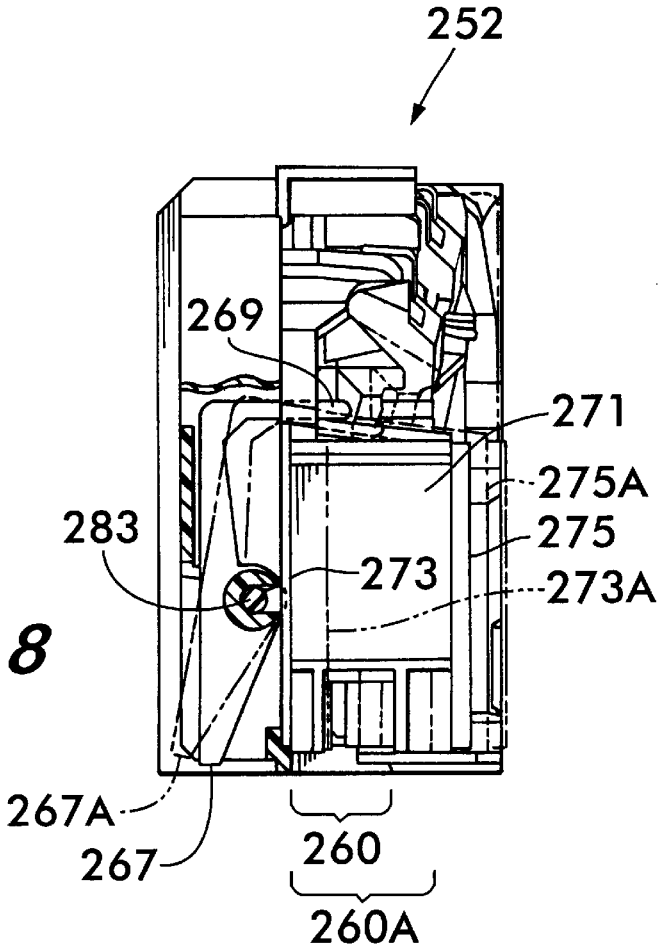
FIG. 8 is a top plan view, partially broken away, of the coin processor.

The coin processor 252 can detect the presence of, and the denomination of, any U.S. coin or foreign coin that is inserted into the hole 236 and can then provide an electronic signal representative of coin entry and coin denomination. In addition, the coin processor can also detect coin jams as well as slug detection and can also provide electronic signals representative of coin jams and the presence of slugs. In particular, the CashFlow® 330 Acceptor can be programmed to process as many as twelve different types of coins, including nickels, dimes, quarters (U.S. and Canadian), as well as British pounds, etc. Furthermore, the upper compartment 262 of the CashFlow® 330 Acceptor is spring-loaded so that it can be displaced away from the sidewall 263. This spring-loaded design permits easy clearance of a coin jam by parking meter personnel without the need to disassemble the modular assembly 248. In particular, should a coin jam occur, parking meter personnel need only remove the cover portion 228 of the meter 220 and introduce any small shaft 265 (e.g., screwdriver) between a pivoting member 267 (to be discussed below) and the catch 257, as shown in FIG. 5, to displace the upper compartment 262 to the right, thereby opening the chute 260 and, in turn, clearing the jam and permitting the coin to fall into the CashFlow® 330 Acceptor for normal processing. The cover portion 228 can then be re-secured by the parking meter personnel and the meter 220 is back in operation. FIG. 8 more clearly depicts the movement of the upper compartment 262 by the introduction of the shaft 265 to open the coin chute 260 and thereby dislodge a coin jam. When the shaft 265 is introduced, the shaft 265 (not shown in FIG. 8) rotates the pivoting member 267, about an axis 283, to a new position 267A (more leftward) shown in phantom. This pivoting action causes the pivoting member tip 269 to displace the upper compartment 262 to a more rightward position. This more rightward position can be seen by reference to the top surface 271 of the upper compartment 262. When the pivoting member 267 is displaced to the position 267A (FIG. 8), the left side 273 of the top surface 271 is moved to a new position 273A (in phantom) and the right side 275 of the top surface 271 is moved to a new position 275A (also shown in phantom). The result is that the coin chute 260 is widened (260A) to facilitate the clearing of a coin jam, allowing the coin to fall through the coin processor 252.

Figure 7:
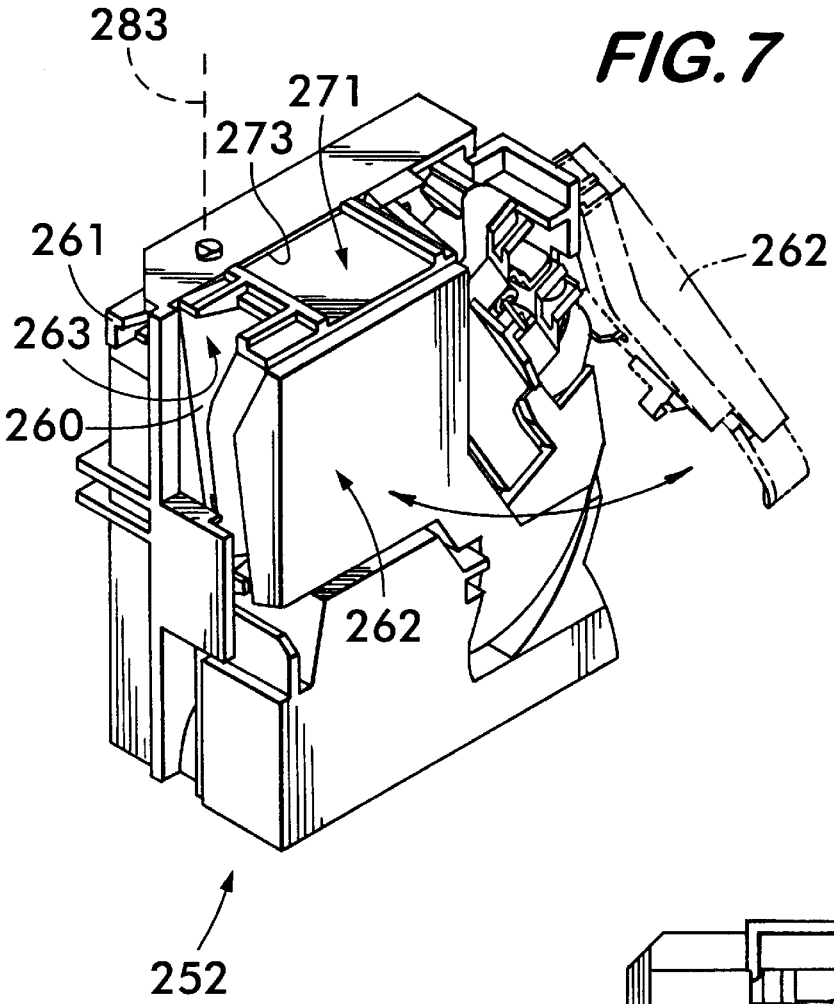
FIG. 7 is an isometric view of the coin processor showing the displaceable compartment.

Should the introduction of the shaft 265 not be sufficient to clear the jam, the modular assembly 248 can be removed from the housing 226, and the coin processor 252 disengaged from the PCB subassembly 250, as discussed earlier. Once the coin processor 252 is removed from the coin PCB subassembly 250, the spring-loaded upper compartment 262 can then be displaced away from the sidewall 263, as shown in FIG. 7, to facilitate the clearance of a coin jam. The coin processor 252 can then be reinstalled into the PCB subassembly 250 and then the entire modular assembly 248 can then be reinstalled into the housing 226.

The modular design of the coin processor 252 is an improvement over other electronic parking meters since the processor 252 is self-contained, i.e., all of the coin sensing, slug sensing, etc., is inside the processor 252. Should the processor 252 become faulty in some aspect, there is no need to disassemble the processor 252; instead, the faulty processor 252 can be replaced with another coin processor 252 and the electronic parking meter 220 remains in operation.

FIGS. 18A–28C are the electrical schematic diagrams for the electronics located on the PCB 20.

As shown in FIGS. 18A–18D, the electronics comprise an auto detector 266, a microprocessor 268 (e.g., a Microchip PIC16C74-S4IL), a coin detector 270, an Infra-Red (IR) transceiver 272, an RF transceiver 274, a payment card reader 276 and an LCD driver 278.

The circuitry of the auto detector 266 (FIGS. 23A–23D) utilizes a sonar transducer 74 as used in the auto detector 100 disclosed in U.S. Pat. No. 5,642,119 whose disclosure is incorporated by reference herein and assigned to the same Assignee, namely, Intelligent Devices, Inc. as the present invention.

In general, like the auto detector 100 of U.S. Pat. No. 5,570,771 and U.S Pat. Nos. 5,407,049 and 5,454,461, the auto detector 266 of the present invention 220 comprises the sonar transducer 74 (e.g., Polaroid electrostatic transducer, Model #7000 or equivalent) for transmitting a sound burst and receiving an echo from any object within its range. By definition, a vehicle is detected if a plurality of consistent readings is received by the auto detector 266 in response to the auto detector 266 interrogations. The amount of consistent readings is programmable by the parking authority personnel.

The auto detector 266 utilizes a plurality of ranges, depending on the conditions of the parking space. For example, in a typical street side parking space, the auto detector 266 may utilize three distance ranges: (1) less than the minimum distance for a vehicle; (2) valid vehicle distance and (3) more than the maximum distance. A detected vehicle must be within the valid vehicle distance range (e.g., three to nine feet). This range is set with a hand held computer (not shown) by parking authority personnel. The maximum distance is determined by the distance that the parking meter 220 detects the street, and this is affected by the orientation of the meter pole 6.

The less than minimum distance, together with the phototransistor 246, is used to detect when someone is leaning against the meter 220 or covering the opening 10. When this happens, and there is no time on the display 232, the display 232 displays "EXPIRED/V" for "violation" and the red LCD 242 on the street side 224 of the meter 220 displays solid red.

A distance of more than maximum, or NO ECHO with light detected, is the normal condition for an empty parking space. If there is no time on the parking meter 220, the display 232 indicates "EXPIRED/0".

The transition from one distance to another is de-bounced, i.e., when the distance moves from one range to another this new range must be verified multiple times in order to determine if it is a temporary change or an actual change of state (FIGS. 28A–28C). Each of the range changes has its own de-bounce count i.e., the number of times it is checked before a new distance range is set. Each of the de-bounce counts is set by the hand held computer. There is an "arrive" de-bounce, a "depart" de-bounce, and a "violate" (i.e., "too close") de-bounce.

Since the transition from one distance range to another may not be solid, i.e., the vehicle may be just on the edge of a range, when a coin is inserted if the car is either out of range or has not been fully de-bounced the assumption is made that there is an "undetected vehicle". Under this "undetected vehicle" condition, time will be put on the meter 220 and will not be reset, even if the vehicle is later detected and then is determined to have departed. Should a new vehicle park in that spot and insert money into the meter 220, the time entered originally may never be zeroed. Therefore, to avoid that situation, if an "undetected vehicle" condition occurs, if the auto detector 266 detects and de-bounces a valid distance, and money is deposited, the meter 220 treats the "undetected vehicle" condition as a new vehicle and when this vehicle departs, the remaining time is zeroed off the meter 220.

When de-bouncing a vehicle that is leaving a parking spot, if a new auto pulls into the spot before the depart is completely de-bounced, an "undetected" flag is set and time is not reset from the meter 220. If money is deposited under this condition time may be bought to the maximum and time will be removed when the car leaves.

The above operation of the meter 220 protects against the parking meter 220 inadvertently removing time from a validly parked vehicle, or erroneously keeping a patron from buying time when he/she has not previously bought maximum time.

Operation of the electronics (FIGS. 23A–23D) of the auto detector 266 are discussed below.

In order to conserve power to enable the use of a power source comprising batteries 256A and 256B only, the transducer 74 is only turned on every ten to fifteen seconds for a few microseconds. The transducer 74 generates a half-millisecond pulse and then waits for approximately 50 msec for a return echo.

The auto detector 266 is initiated by a command signal (AUTO INIT, FIG. 23A) from the microprocessor 268 when the microprocessor 268 determines that it is time to look for a vehicle. If the auto detector 266 receives a return echo indicating that a vehicle is present at the parking location, a signal (AUTO ECHO*, FIG. 23D) is sent back to the microprocessor 268. In particular, when the microprocessor 268 is ready to check for a vehicle, the processor 268 brings AUTO INIT high (pin 42 from the microprocessor 268, FIG. 20C). When AUTO INIT goes high, pin 1 of U1A is high and the capacitor C1 begins charging through resistor R6. While AUTO INIT is high but before C1 charges, both pins 1 and 2 of U1A are high, therefore pin 3 of U1A is low and is inverted through Q2, enabling U1B and permitting the 50 kHz oscillator attached to U1 pin 4 to be applied to the Q1 base. This applies a 50 kHz signal to the transducer 74 through a transformer T1, capacitor C12 and out through the transducer connector J2. T1 has a turns ratio of 50 in order to apply a 150 volt signal to the transducer 74. The capacitor C12 is used to block any DC voltage from the transducer 74 and forms a 50 kHz series resonant circuit with T1 and the transducer 74. When Cl charges up, Q6 is turned on, thereby disabling gates U1A and U1B, which turns Q1 off and therefore turns off the signal to the transducer 74. The transmit burst lasts approximately 500 $\mu$sec.

Figures 23, 23A, 23B, 23C, 23D:
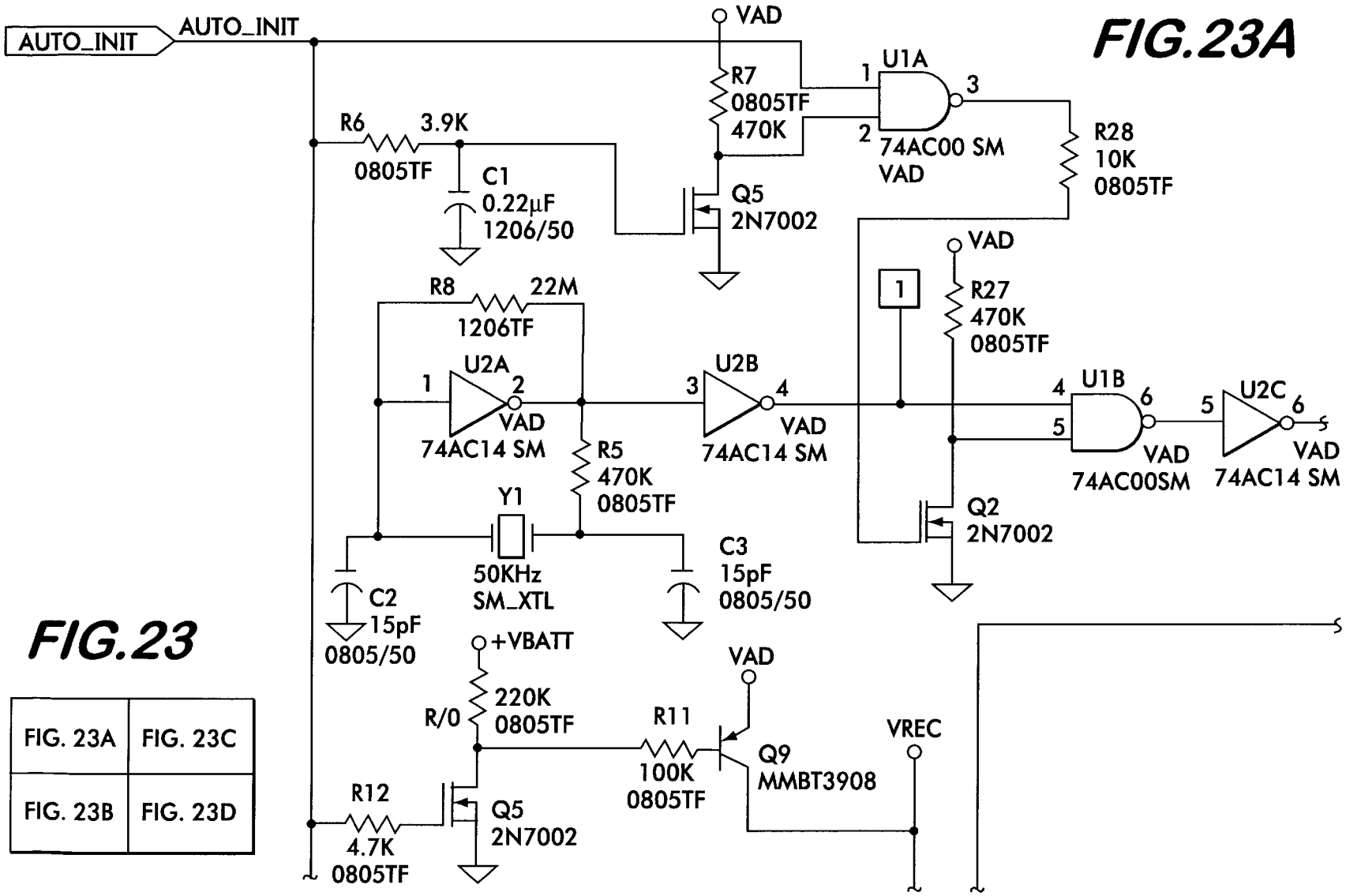
FIG. 23 is a figure layout for FIGS. 23A–23D.
FIG. 23A–23D constitute an electrical schematic diagram of the auto detector.
Figure 23B:
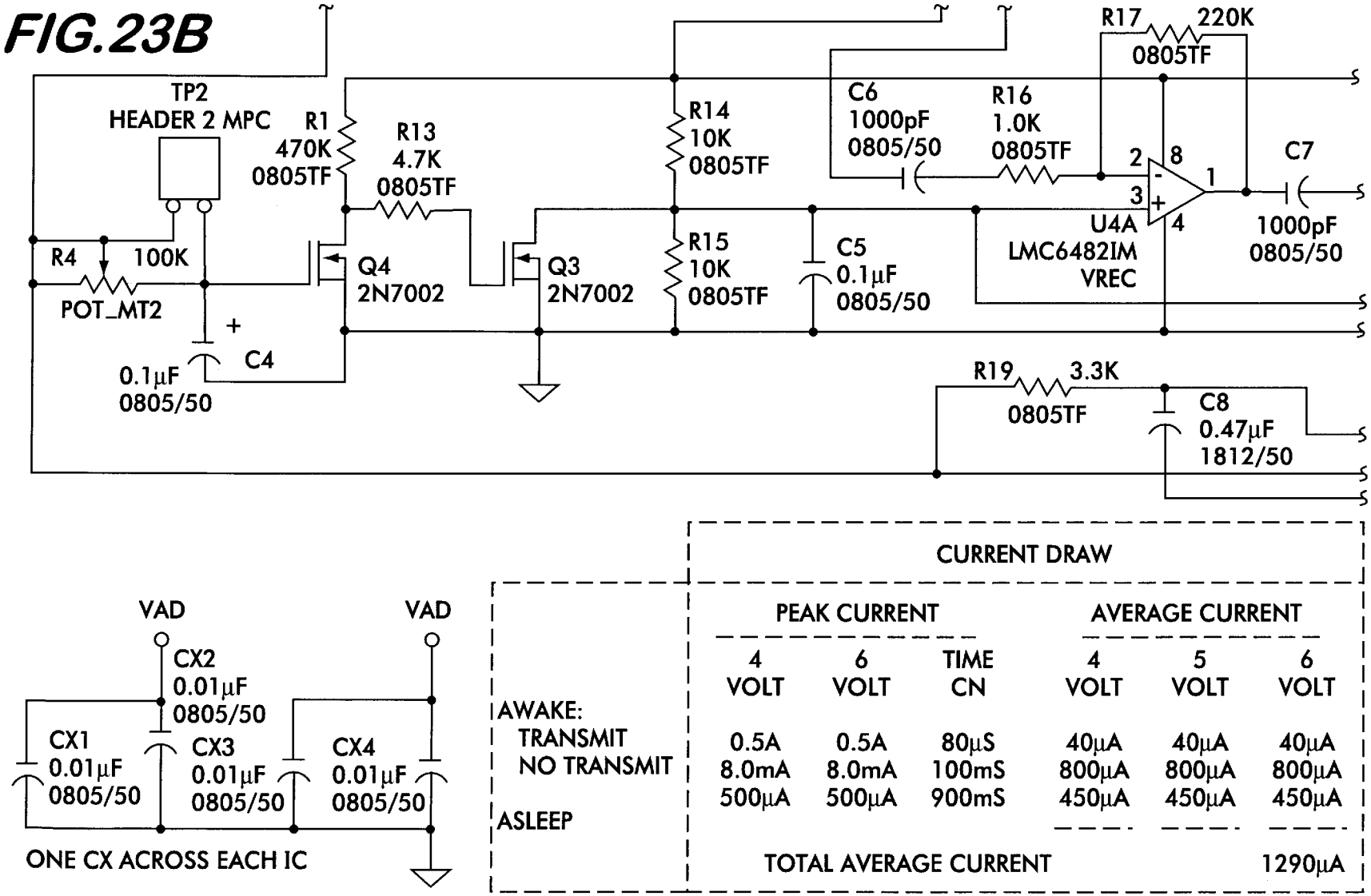
Figure 23C:
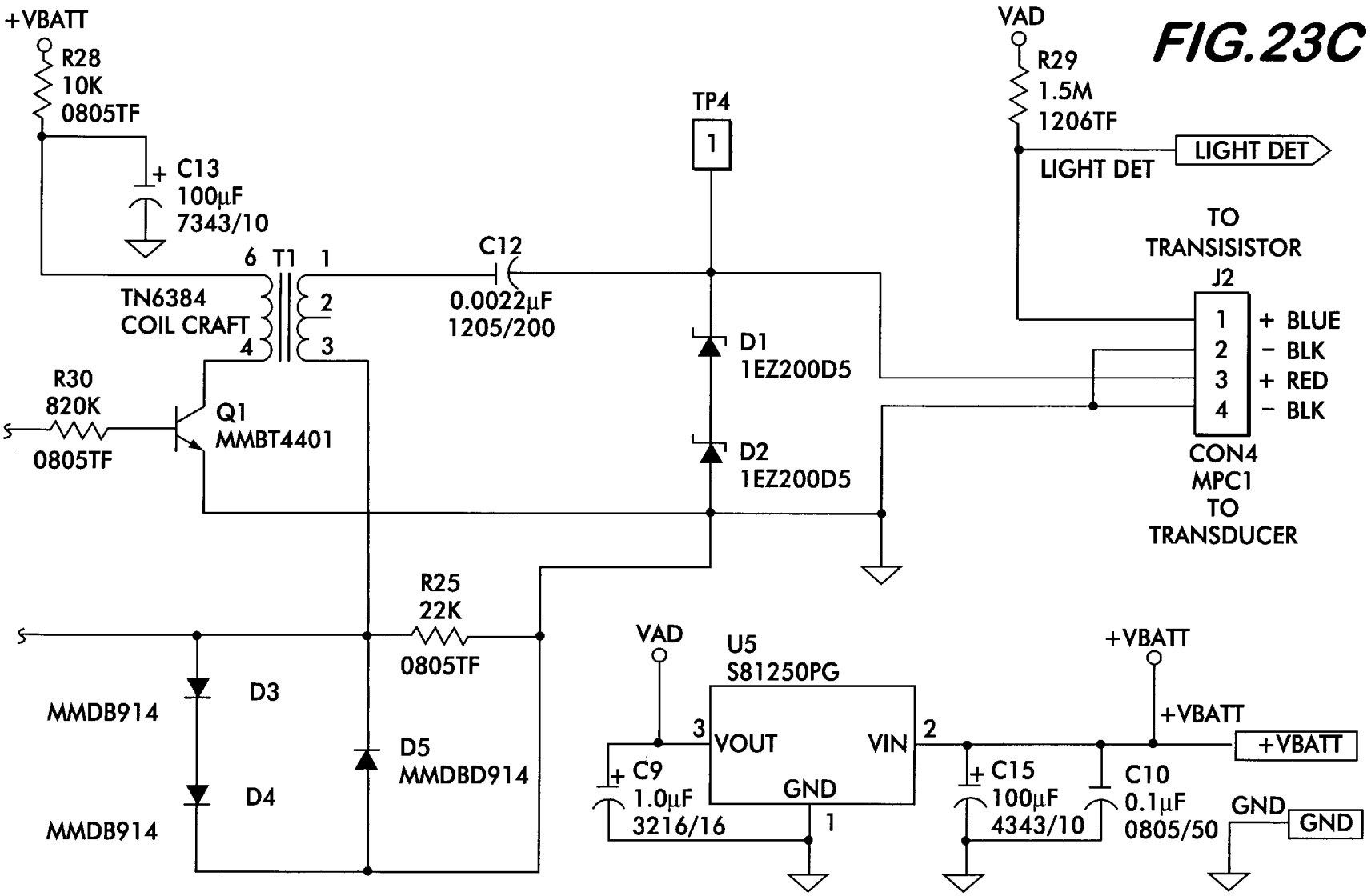
Figure 23D:
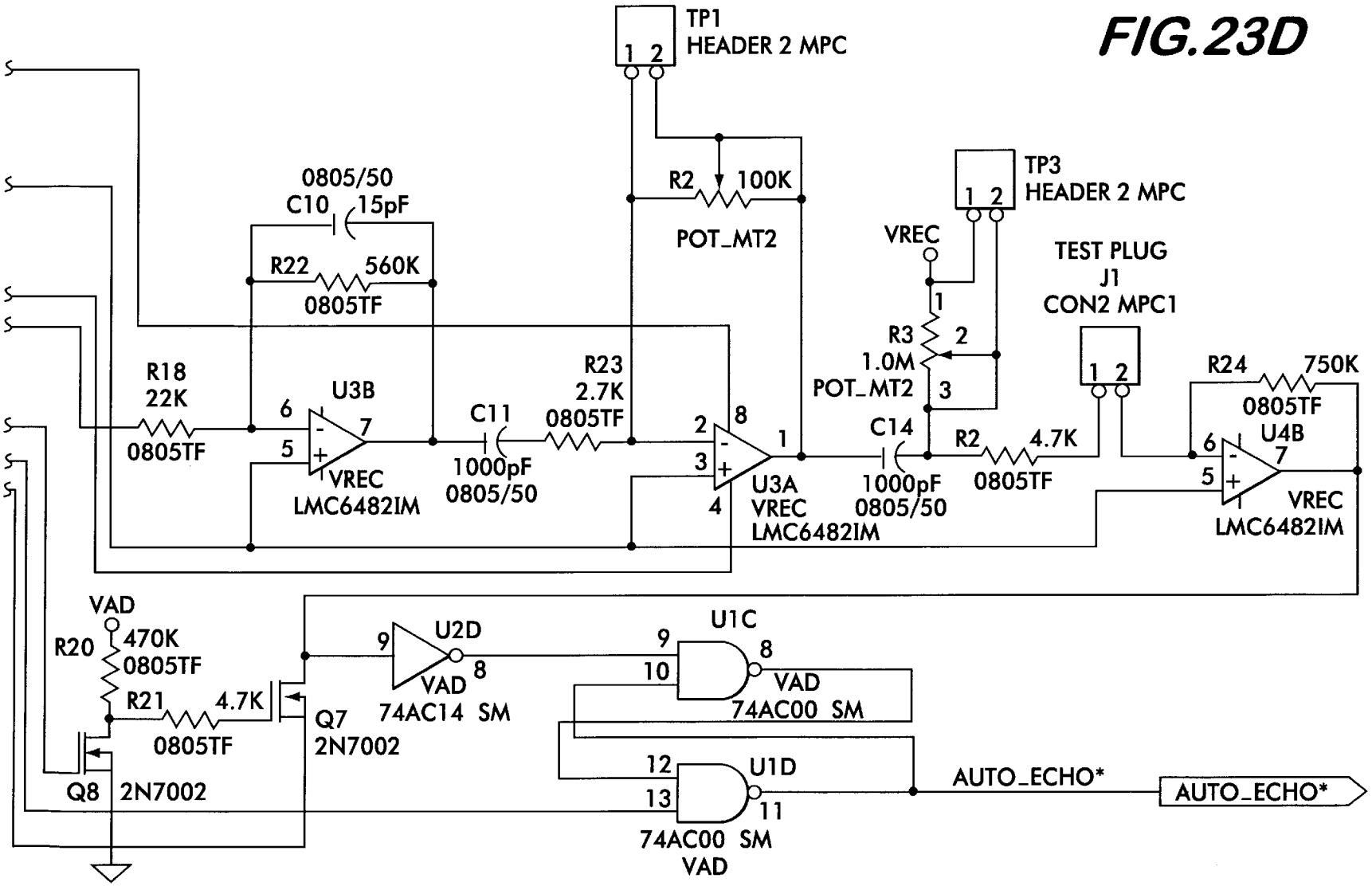

The AUTO INIT signal is also used to turn on a transistor Q5 (FIG. 23A). When Q5 is turned on, power to the auto detector 266, VAD, is applied to the vehicle detection receiver (FIG. 23B). The AUTO INIT signal is also applied to resistor R4 and capacitor C4. This RC combination, in conjunction with the double inverter Q3 and Q4, is used to disable the receiver (FIG. 23B) during the transmit signal and for a short time thereafter. The AUTO INIT signal is also applied to the auto detector output circuit in order to enable the output flip flop U1C and U1D (FIG. 23D). Finally, the AUTO INIT also enables pin 7 of U4 after a delay determined by R19 and C8.

After the transducer 74 signal is transmitted, the transducer 74 waits for a return echo. When an echo is received by the transducer 74, the signal passes through the capacitor C12 and the secondary of transformer T1 and is applied to the receiver. The receiver amplifies the signal in U4A, U3A and U3B. U4B is used to convert the signal to a digital level and for setting the flip flop U1C and U1D. Once the digital signal sets the flip flop U1C and U1D, an AUTO ECHO signal goes high. The AUTO ECHO signal is sent to the microprocessor 268 on pin 41. The microprocessor 268 calculates the time between AUTO INIT and AUTO ECHO to determine the distance to the target. If no echo is received within 50 msec, the microprocessor 26 brings the AUTO INIT to a low level, thereby resetting the auto detector 266 and turning off its power.

Furthermore, an improvement to the auto detector 100 of U.S. Pat. No. 5,642,119 is the inclusion of the phototransistor 246 connected to the auto detector 266 of the present invention 220. As shown in FIG. 18A, a transducer assembly 280 represents both the sonar transducer 74 and the phototransistor 246 that are electrically coupled to the auto detector 266 through a common harness/connector 282. As shown in FIG. 2, the phototransistor 246 is mounted just behind the mesh 12 in the sonar transducer aperture 10. The phototransistor 246 supplies a brightness level to the auto detector 266 which is then transmitted by the auto detector 266 to the microprocessor 268, as indicated by the LIGHT DET signal in FIG. 23C, for two purposes. First, the microprocessor 268 monitors this brightness level and if it detects a first predetermined decrease (e.g., 50%) from the sunlight/daylight level for a predetermined time, the microprocessor 268 concludes that it is dusk/nighttime and thereby activates a backlight to the sidewalk side display 232 to facilitate patron reading of the display 232. Second, if the microprocessor 268 detects a second predetermined decrease (e.g., 25%) from the first predetermined decrease within two transducer interrogations, the microprocessor 268 concludes that the sonar transducer aperture 10 is being covered, whether inadvertently or intentionally. Being able to detect that the transducer aperture 10 is being covered permits the meter 220 to continue counting down the allowed parking time as if the transducer aperture 10 were not covered; otherwise, the meter 220 would consider a blocked transducer aperture 10 to mean the parked vehicle has left the parking space, thereby erroneously causing the meter 220 to zero out the paid-for parking time.

As shown in FIGS. 20A–20F, the microprocessor 268 can be implemented using a Micro Chip PIC16C74 Microcontroller (FIG. 20D), which has 4K words of internal program ROM and 192 bytes of internal RAM. In addition, the microcontroller has three parallel eight bit I/O ports, any or all of which could be interrupt inputs.

The temperature sensor U10 (FIG. 20A) together with diodes D5 and D7 and resistor R40 are used by the microprocessor 268 to determine the temperature in the meter 220 in order to adjust any parameters that are sensitive to changes in temperature. U11A and resistors R36 and R37 are used by the microprocessor 268, as a reference, to determine the battery (256A/256B) voltage level and report when the battery falls below a predetermined level.

There are two crystals, Y2 and Y3, attached to the microprocessor 268. The 4.00 MHz crystal Y2 (FIG. 20C) is used as the base oscillator when the microprocessor 268 is awake, and the 32.768 kHz crystal Y3 (FIG. 20B) is used when the microprocessor 268 is asleep.

To reduce the number of signal lines coupled to the microprocessor 268, a multiplexor 284 (e.g., CD40528CM, multiplex chip U9, FIG. 20B) is coupled to the microprocessor 268.

Figures 2O, 19, 20A:
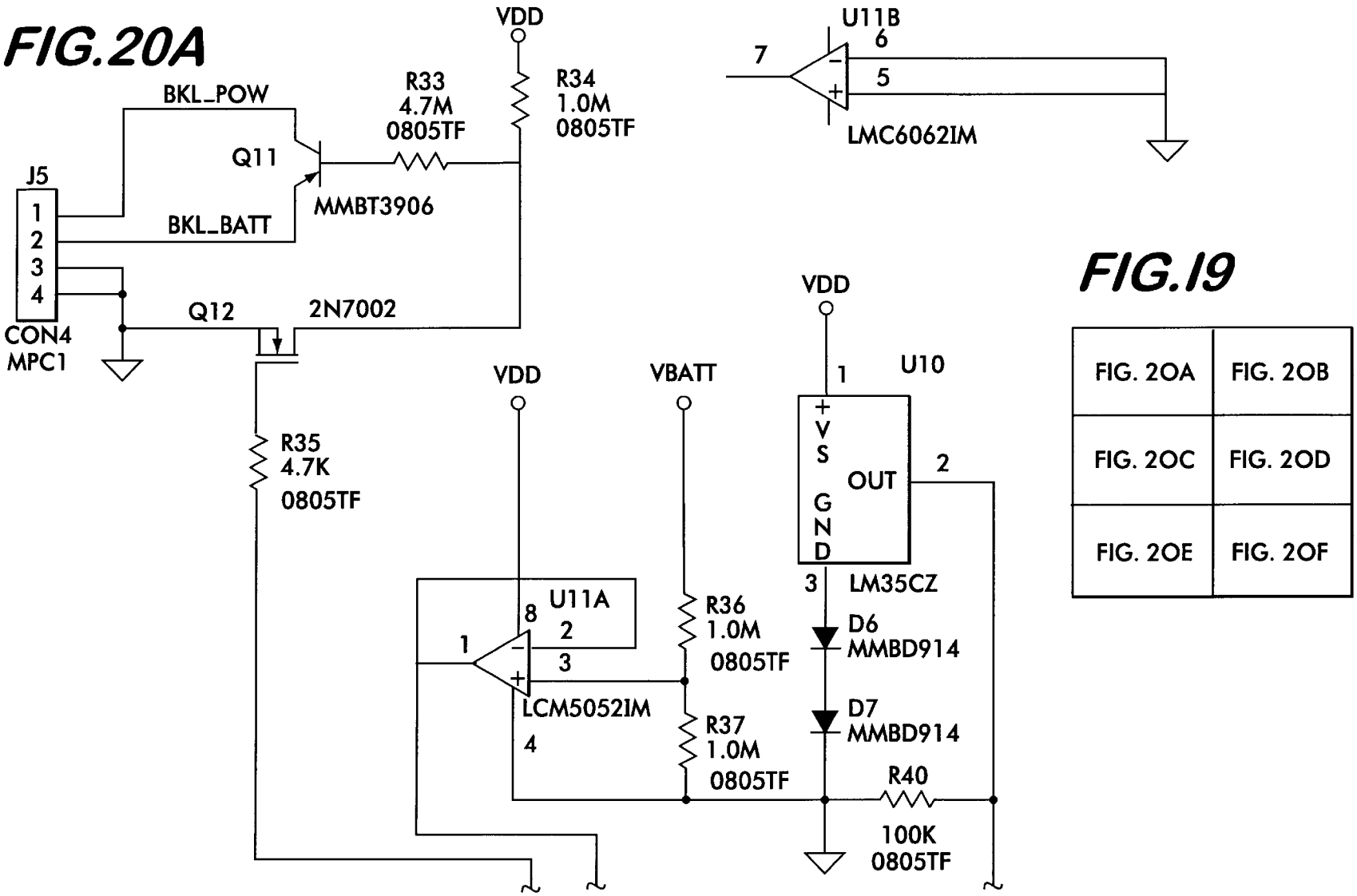
Figure 20B:
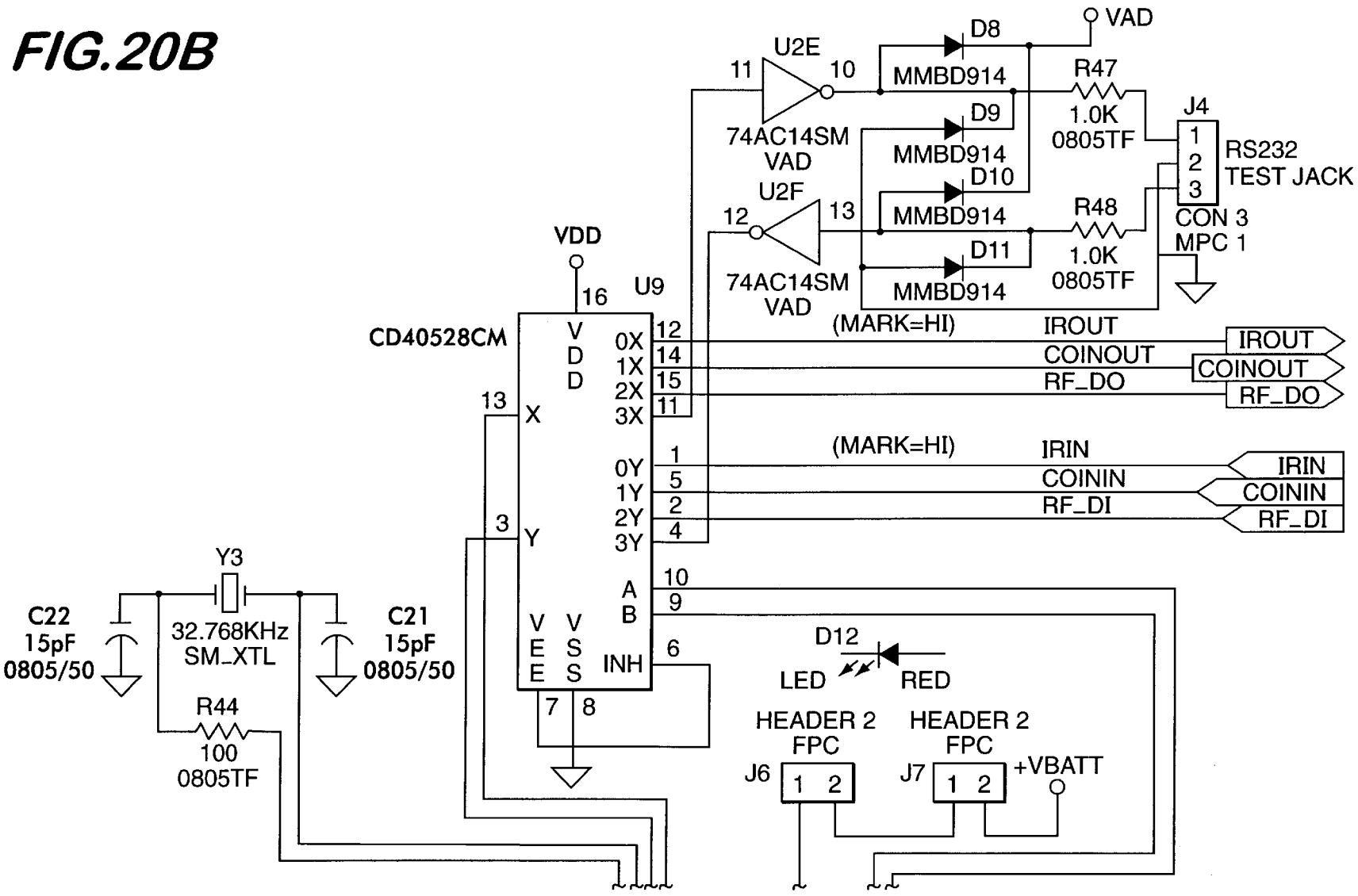
Figure 20C:
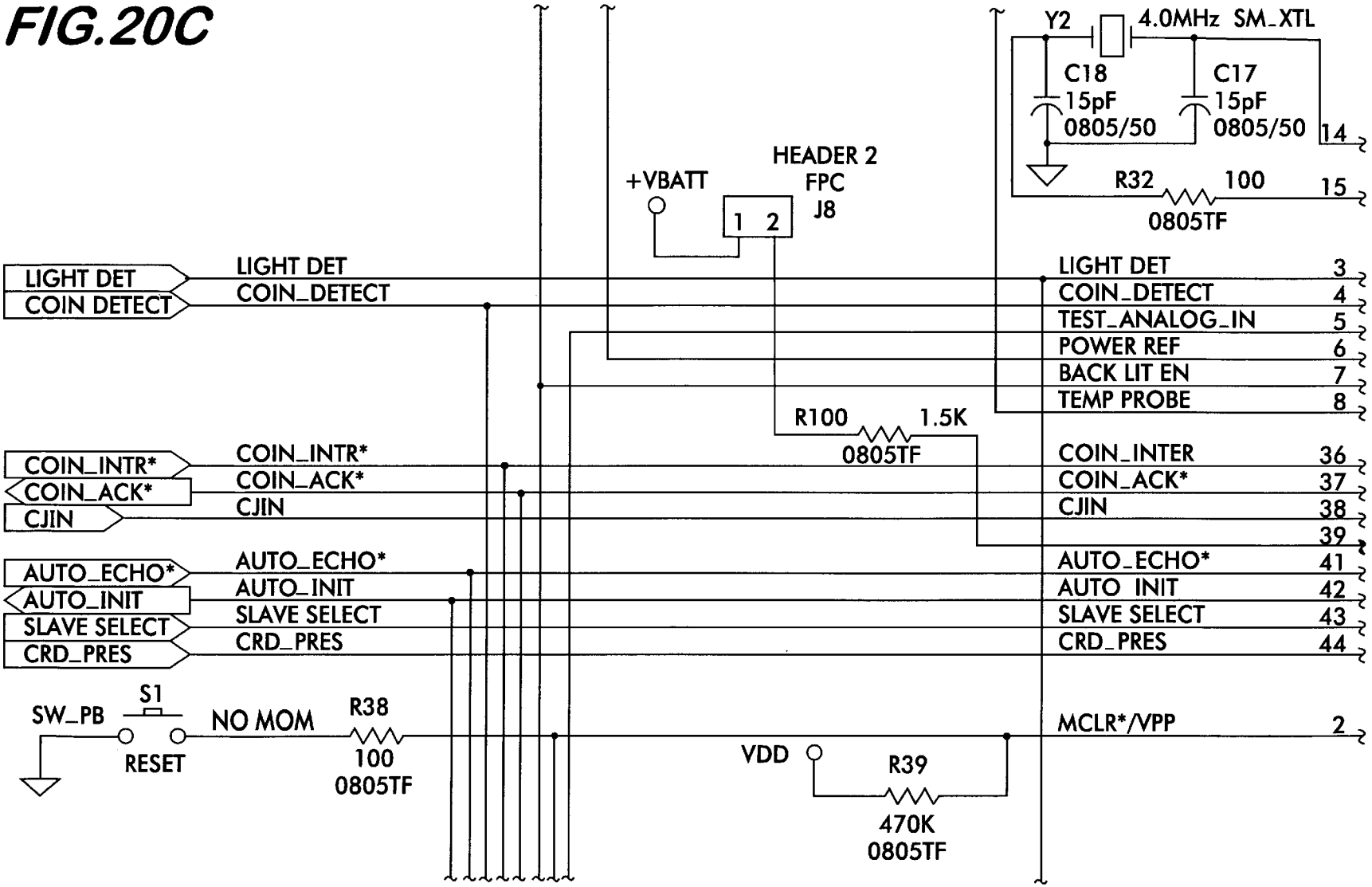
Figure 20E:
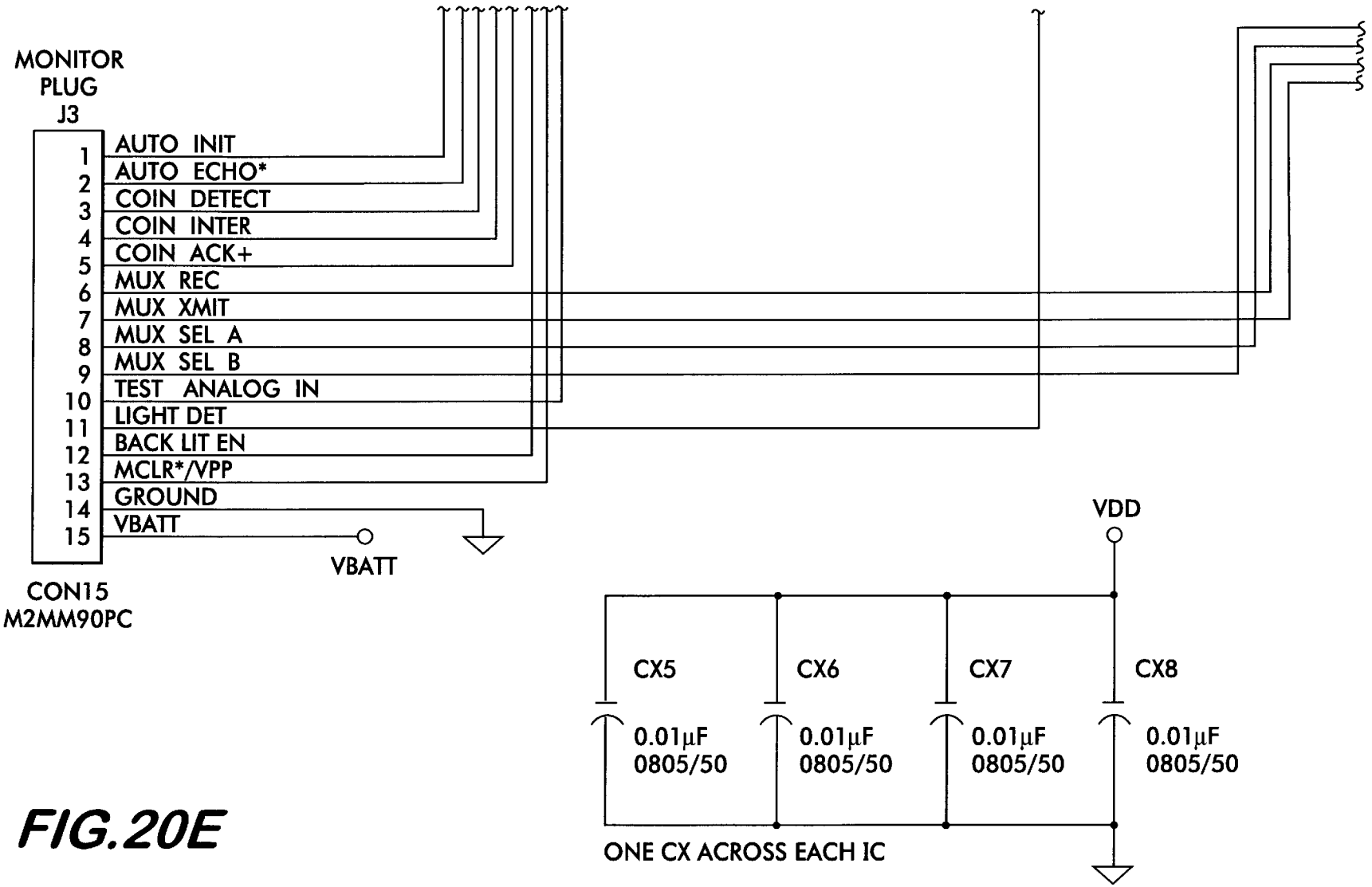
Figure 20F:
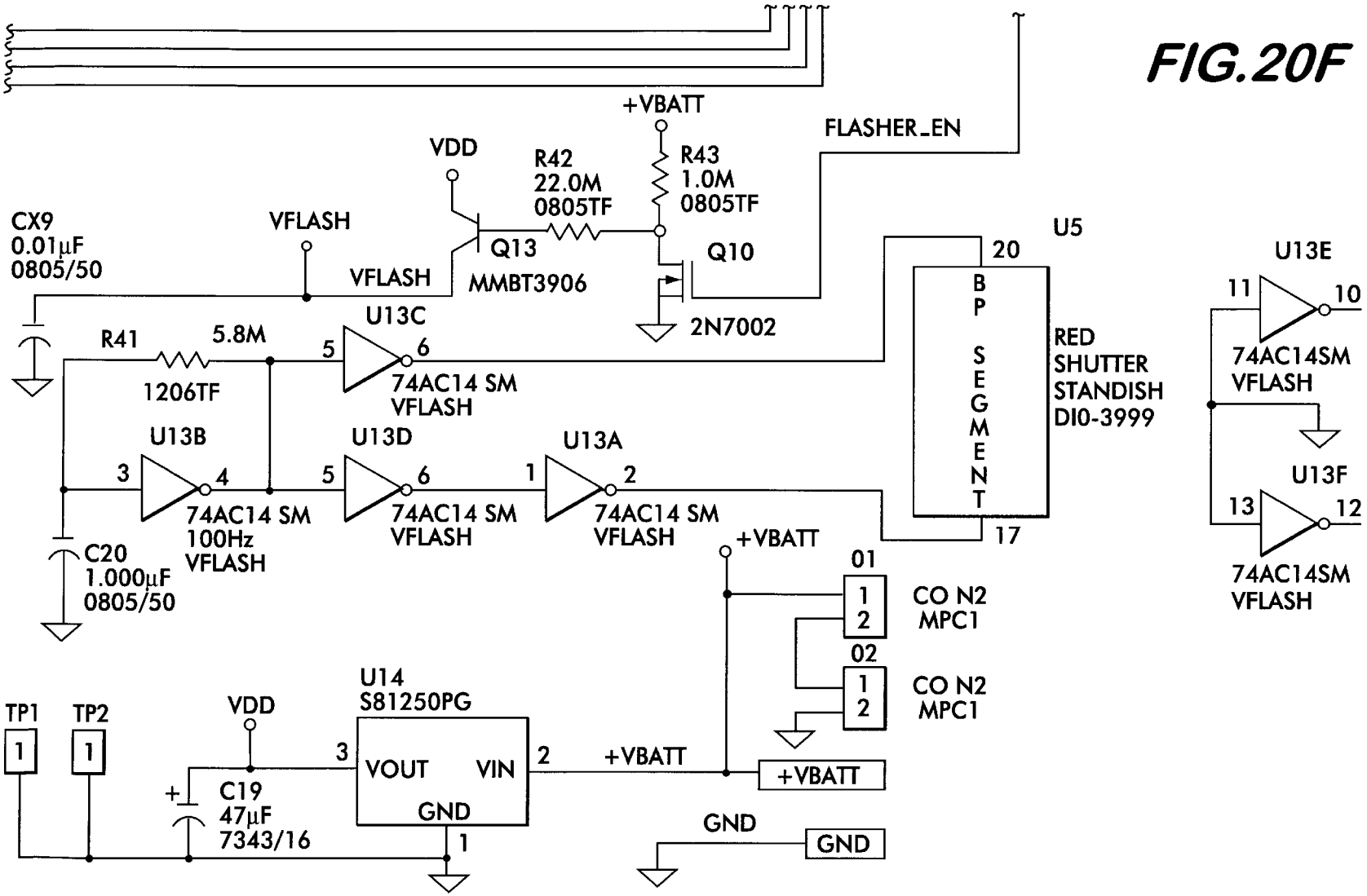

In FIG. 20F there is shown the circuitry for controlling the red LCD flasher 242. The flasher 242 is used to alert the parking authority when a vehicle is parked at a meter 220 and the time has expired. If there is no vehicle parked at the meter 220, or if there is a vehicle parked there with time on the meter 220, the flasher 242 is off. If the parking meter 220 detects a problem within itself, it turns the flasher 242 on solid in order to alert the parking enforcement officer. The LCD flasher 242 must never have a DC voltage applied to it, therefore, U13, R41 and C20 are set up as a 100 Hz multivibrator. In order to conserve power, whenever the flasher 242 is flashed off or turned off, the power, VFLASH, is removed from the entire circuit. In order to remove power from the circuit, the microprocessor 268 de-activates the FLASHER EN (pin 33 from the microprocessor 268). When pin 33 is de-activated, Q10 turns off, thereby turning off Q13 and removing power from the entire flasher 242 circuit.

The coin detector 270 (FIG. 22) provides the interface between the coin processor 252 and the microprocessor 268. The coin detector 270 converts the bidirectional signals to and from the coin processor 252 into discrete input/output signals to and from the microprocessor 268. The coin processor 252 communicates with the microprocessor 268 via serial RS-232-like interface. P1 is the physical interface to the coin processor 252. Power (VCD) is applied to the coin processor 252 through pins 7 and 9 of P1 while ground is applied to pins 2, 4 and 8. Pin 5 (COIN—DETECT) and pin 10 (CJIN) are not used in the present embodiment. Pin 1 is the serial data from the coin processor 252 and is converted to COINOUT and COININ and sent to the microprocessor 268 through multiplexor 284 U9 on pins 5 and 14. A COIN—INTER* signal is a signal from the coin processor 252 to the microprocessor 268 pin 35 and is active when the coin processor 252 is sending data to the microprocessor 268. A COIN—ACK* signal is a signal from the microprocessor 268 pin 37 to the coin processor 252 to indicate that serial data is being sent from the microprocessor 268 to the coin processor 252. The content of the messages to and from the coin processor 252 is software controllable.

Figure 21A:
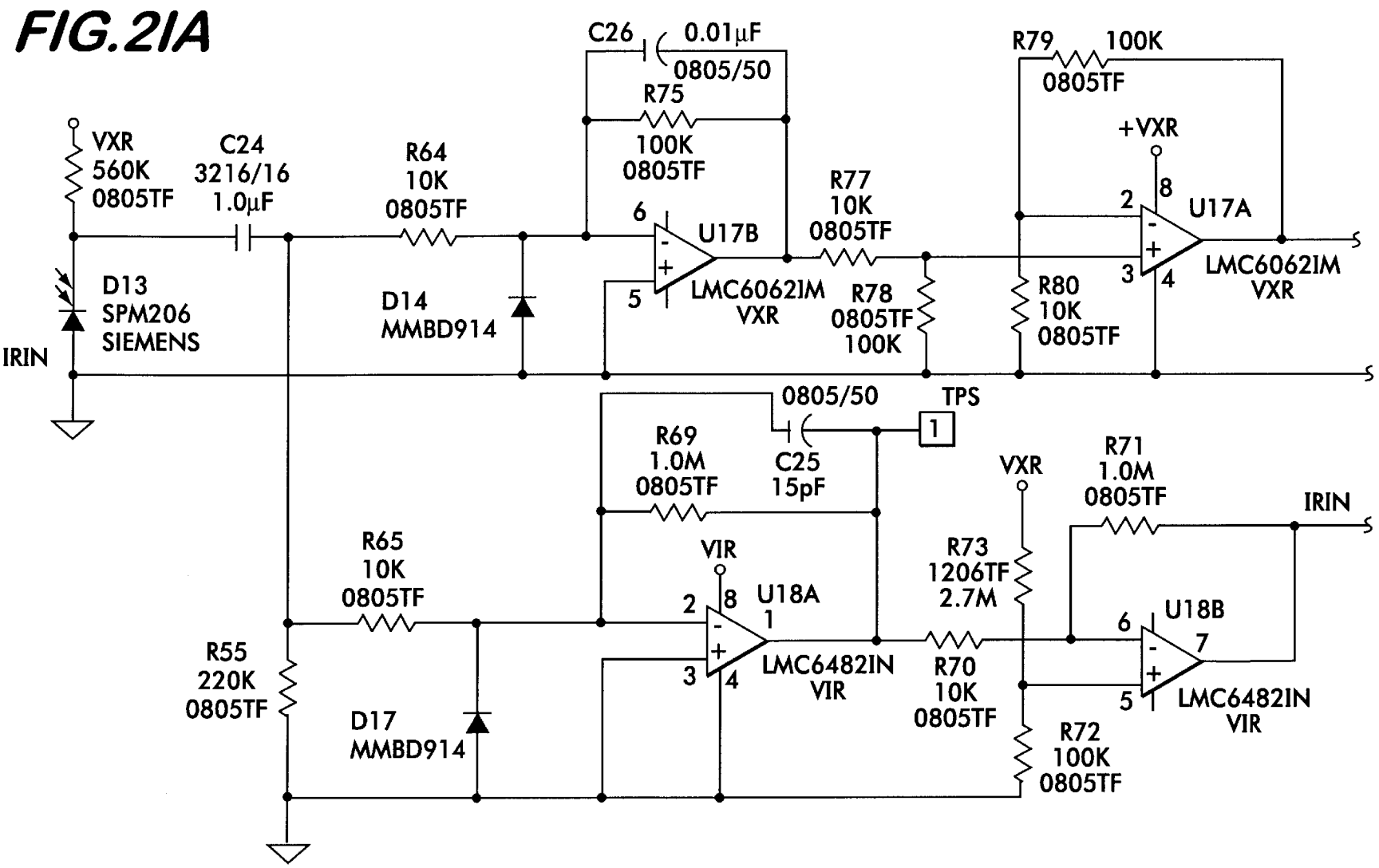
FIG. 21A–21C constitute an electrical schematic diagram of the IR transceiver.
Figure 21B:
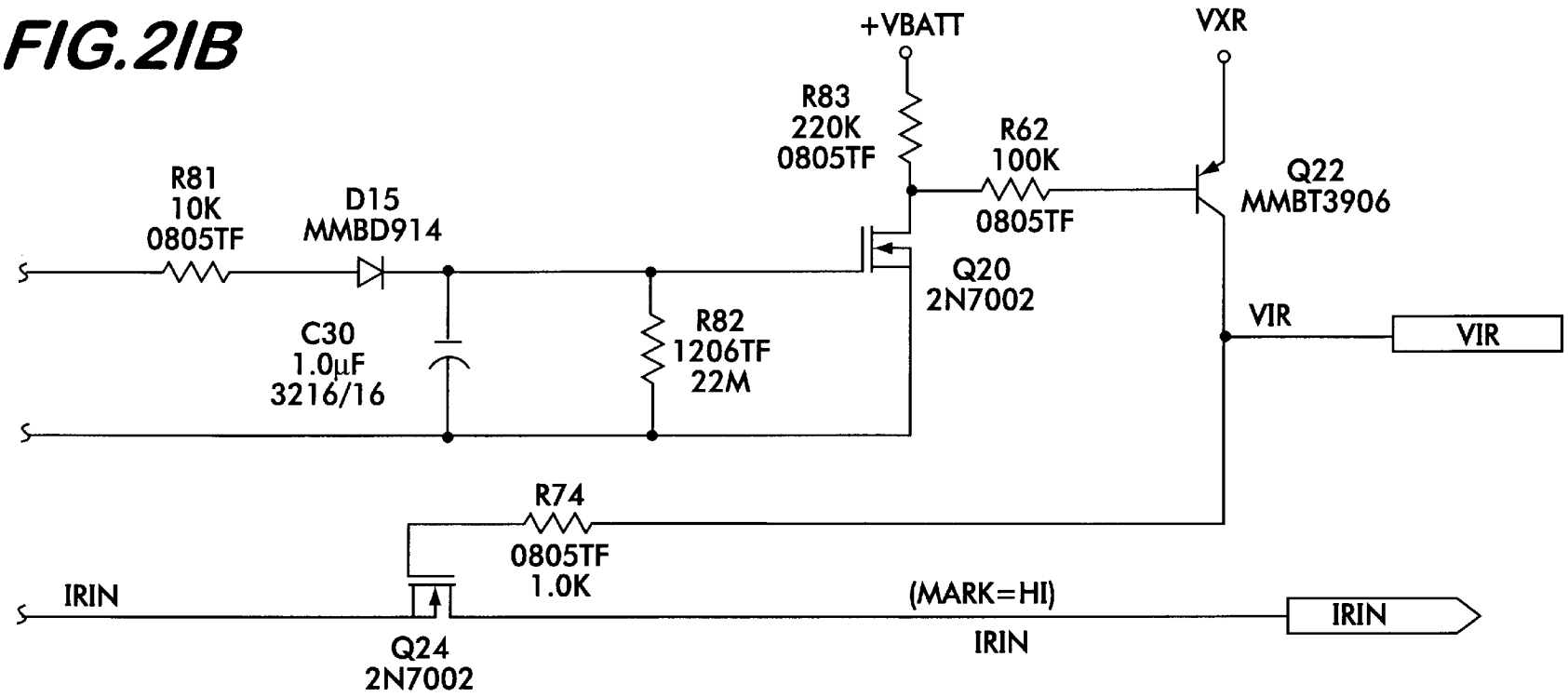
Figure 21C:
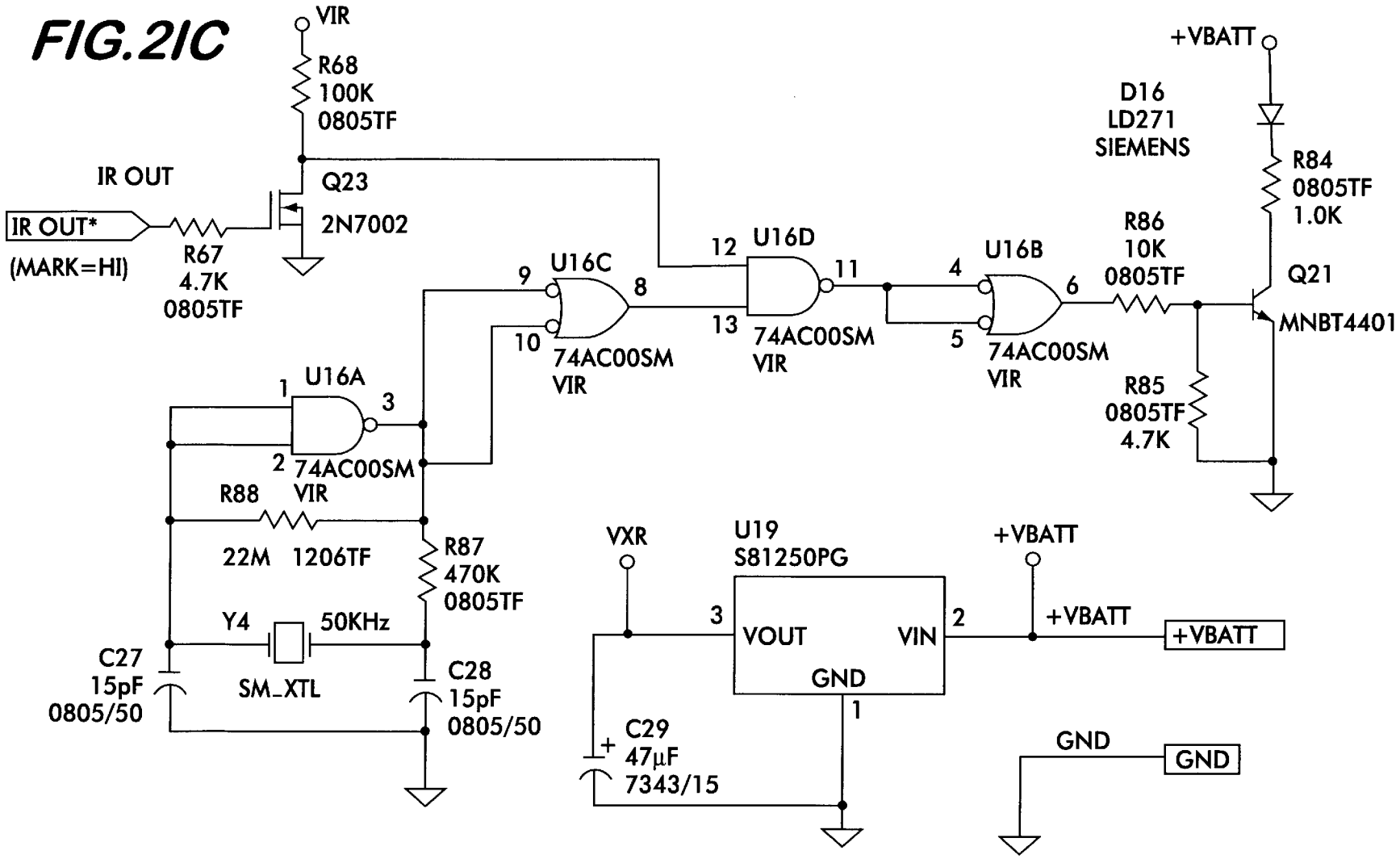
Figure 22:
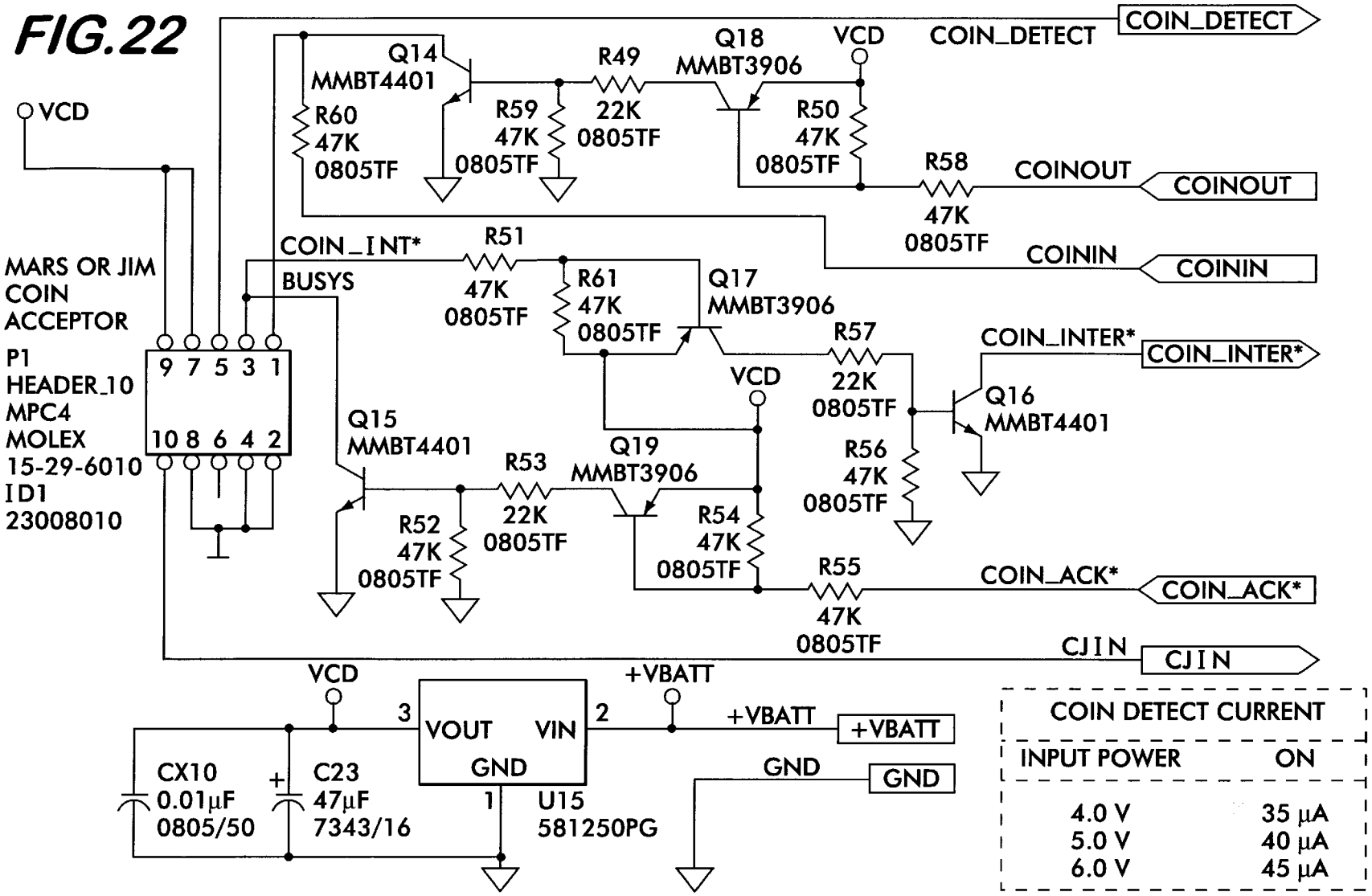
FIG. 22 is an electrical schematic of the coin detector.

The IR transceiver 272 is shown in FIGS. 21A–21C. The electronic parking meter 220 never initiates an infrared transmission. The microprocessor 268 waits for a signal from an external transmitter. Therefore, in order to save power, the power is normally automatically removed from the transceiver 272. The energy from the first byte in the received signal received by the IR detector (FIG. 21A) in the IR transceiver is used to turn on the power to the IR transceiver 272.

As shown in FIG. 21A, diode D3 (disposed in the opening 23 of the PCB board 20 discussed earlier) and resistor R63 form an IR detector. When an external IR transmitter (not shown) sends data to the parking meter 220, the IR detector sends the data to both a power switch and the IR receiver (FIGS. 21A–21B) at this time. Therefore, the first byte of data is sent through capacitor C24 to block the DC component and is applied to a bleeder resistor R66. This data is then applied to a comparator U17B through a resistor R64. The output of this comparator U17B is sent to an op-amp stage U17A through a resistor R77. The ratio of resistors R79 and R80 set the gain of the op-amp and the divider R77 and R78 determine the set point of the amplifier. The output of this amplifier stage is applied to a sample and hold stage made up of D15, C30 and R62. The purpose of R62 is to set the decay time of the sample and hold circuit, and therefore, the length of time that power is applied to the IR transceiver 272. The sample and hold voltage is used to turn on Q20 which turns on Q22 and applies power to the IR transmitter (FIG. 21C) and receiver. The sample and hold circuit is set to apply power for ten seconds after the last received data.

As a result of the above process, the first received byte of data is lost, therefore, the IR transmitter must always begin the first transmission with a dummy byte of data.

After the power is applied to the transceiver 272, the rest of the received data is sent to IR receiver U18 across R66, and through R65. The ratio of R65 and R69 set the gain of the first stage of the IR receiver. The output of the first amplifier is applied to applied to the second amplifier through R70. The ratio of R70 and R71 set the gain of the second amplifier stage and the divider R73 and R72 set the operational point of the amplifier. The operation point of this stage is set to generate a logic level output to send IRIN to the microprocessor 268 through the multiplexor 284 pin 1 (FIG. 20B). The microprocessor 268 sends IROUT through the multiplexor 284 pin 12 to the IR transmitter (FIG. 21C). The output data is applied to the gate of Q23 and then inverted and this data is applied to the two input nand gate U16D pin 12 and a 50 kHz oscillator, made up from U16A, U16C, R88, and Y4, is applied to pin 13, the other input of U16A. Since the inverted IROUT is high for a space and low for a mark, the 50 kHz signal is sent out for spaces only, during a mark the IR transmitter is turned off. The output of U16D is inverted in U16B and applied to the base of Q21 through current limiting resistor R86. A positive voltage applied to resistor R86 turns on Q21 and pulls current through limiting resistor R84 and IR transmitter diode D16 (disposed in the opening 23 of the PCB board 20 discussed earlier). This current turns on diode D16 and transmits the data.

The external transceiver (not shown) referred to in the above description is accomplished in this system by a hand-held computer with an IR attachment. The data sent between the hand held computer and the parking meter 220 is statistical data and maintenance data on the parking meter 220 and programming data from the hand held computer to the parking meter 220.

Figure 24:
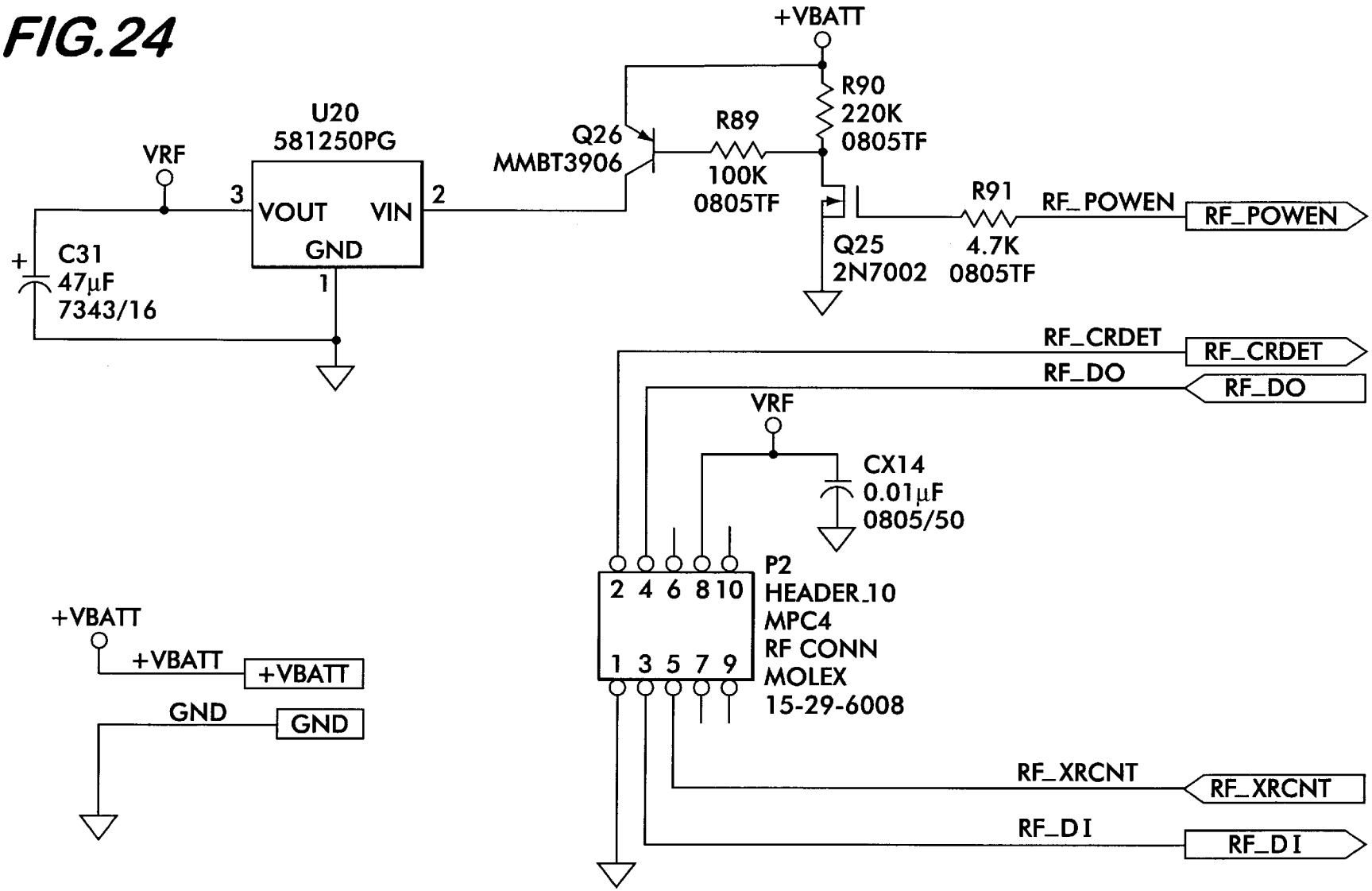
FIG. 24 is an electrical schematic of the RF transceiver.

The RF transceiver 274 is shown in FIG. 24. The RF transceiver 274 is used to alert the parking authority when a vehicle is parked at a meter 220 and the time has expired. It is also to transmit statistical and maintenance data about the meter 220 to the parking authority. The parking authority can program the parking meter 220 through the RF transceiver 274. Data received by the RF receiver is used to switch power on to the RF transceiver 274 in the same way that the IR transceiver 272 powers itself up. Data received by the RF receiver is sent to the processor 268, through the RF connector P2 (FIG. 24), then through the multiplexor 284 pin 2 (FIG. 20B), as RF_DI. Transmit data from the microprocessor 268 is sent out of the multiplexor 284 pin 15 as RF—DO. The RF—DO signal is sent to pin 4 of P2 (FIG. 24). Pin 2 (RF—CRDET) and pin 7 of P2 are not used.

There are to be two types of RF transceiver systems. The first system requires a mobile RF transceiver (not shown) that automatically broadcasts a wake-up signal to a bank of electronic parking meters 220 (e.g., one street block) to transmit their respective parking meter data/status, if any, to the mobile RF transceiver. Each parking meter 220 responds by transmitting its corresponding parking meter data/status subject to a random delay that prevents transmission collisions due to the other electronic parking meters 220 transmitting. Should a collision still occur, one of the electronic parking meters 220 would back off and try again after another random delay. This mobile RF transceiver can be in the form of either a hand-held unit or a unit that is located in a roaming parking authority van. In either case, the mobile RF transceiver comprises a computer that receives the electronic parking meters' 220 data. Once the current parking meter data/status is received and acknowledged by the mobile RF transceiver, the electronic parking meter 220 remains silent until another wake-up signal is received and new parking meter data/status arise. In addition, once the mobile RF transceiver has collected the parking meter data/status, the appropriate action is taken by the parking authority, e.g., if a parking violation has occurred a parking authority agent is contacted to issue a ticket accordingly, or if a jam has occurred, a maintenance crew is called.

A second RF transceiver system would not require an RF hand-held transceiver for each parking enforcement officer, nor an RF transceiver in a roaming van, but would require that the town utilize a network with RF repeaters (not shown) at specific corners. Each repeater would interrogate a predetermined set of meters 220 and transmit their data to headquarters. This would allow the parking authority to get immediate information on each meter 220 and allow them to make more efficient use of their parking enforcement officers and maintenance personnel. As an example of the communication system to be used with the RF transceiver 274, a CellNet communications network can be used with the RF transceiver. In contradistinction to the Lemelson patent which discloses a wireless system using shortwave radio, the CellNet operates in the 952/928 MHz frequency range. The wireless transmission would allow transmission to either a central point or to a mobile unit for the purpose of communicating parking activity and revenue information on a daily, weekly, monthly basis for individual meters 220, such as, but not limited to:

- parked car count
- accumulated parked time
- average park time
- empty space count
- accumulated empty time
- average empty time
- paid car count
- accumulated paid time
- average paid time
- reset car count
- accumulated reset time
- average reset time
- grace period count
- accumulated grace time
- average grace time
- expired time count
- accumulated expired time
- average expired time
- slug count
- extended time attempts (the number of coins deposited in a failed attempt to purchase more time than the preset maximum)
- expired meter
- low battery
- jammed
- cash total
- maximum coin capacity
- sensor broken.

Figure 25:
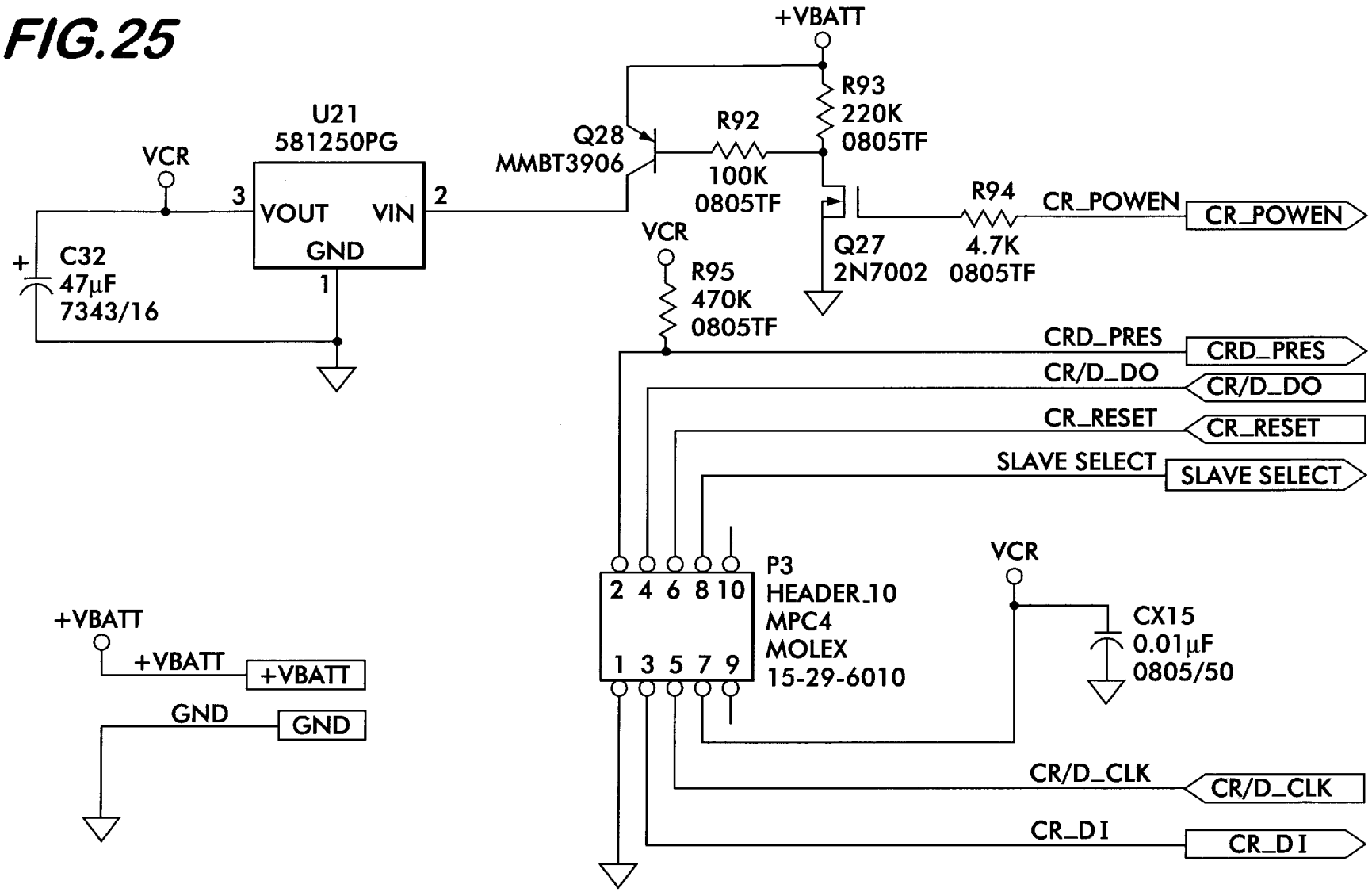
FIG. 25 is an electrical schematic of the payment card reader.
Figures 26, 27A:
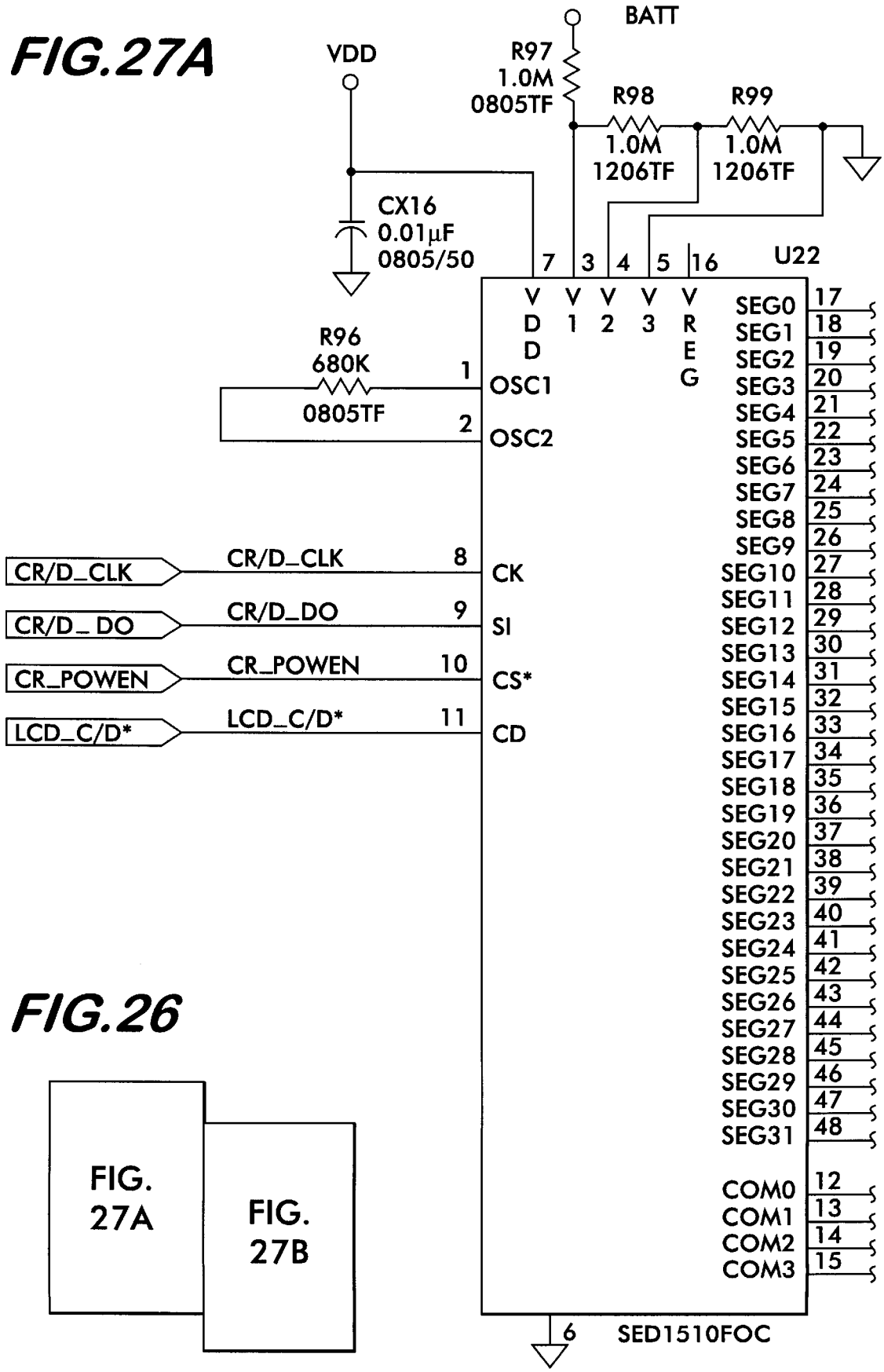
FIG. 26 is a figure layout for FIGS. 27A–27B.
FIGS. 27A–27B constitute an electrical schematic of the LCD driver.
Figure 27B:
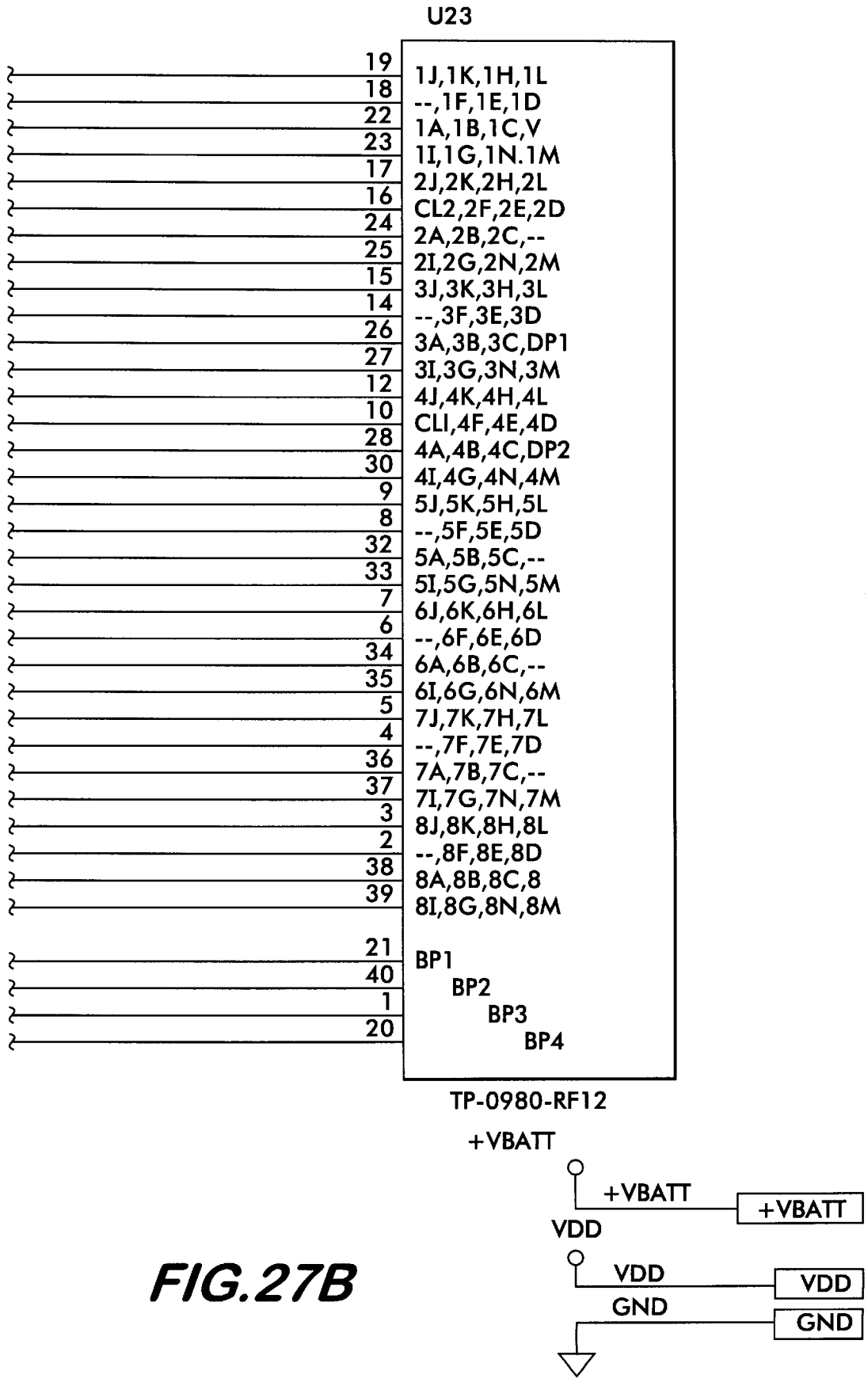
Figures 28, 29A:
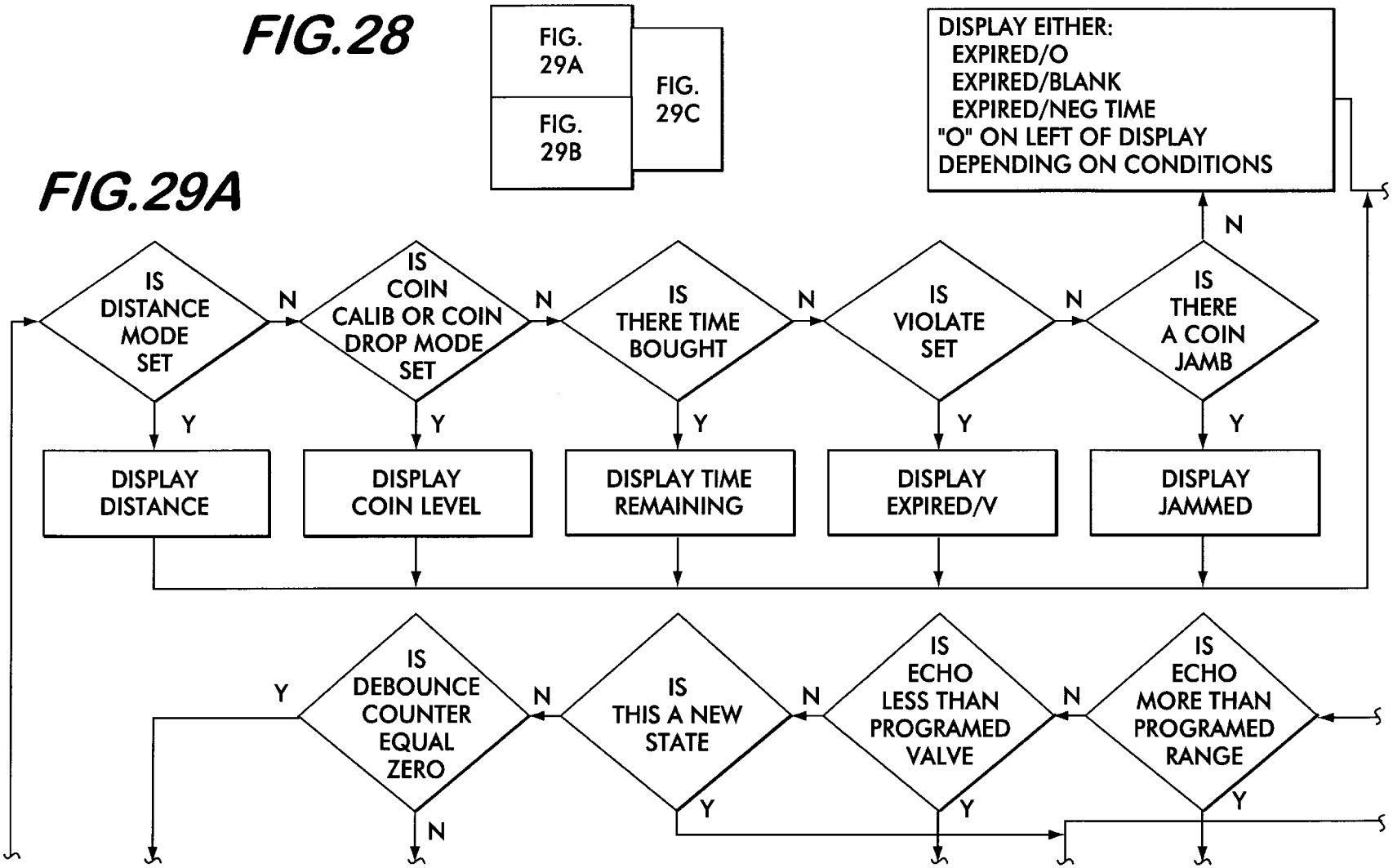
FIG. 28 is a figure layout for FIGS. 29A–29C.
FIGS. 29A–29C constitute a flow chart of the electronic parking meter operation.
Figure 29B:
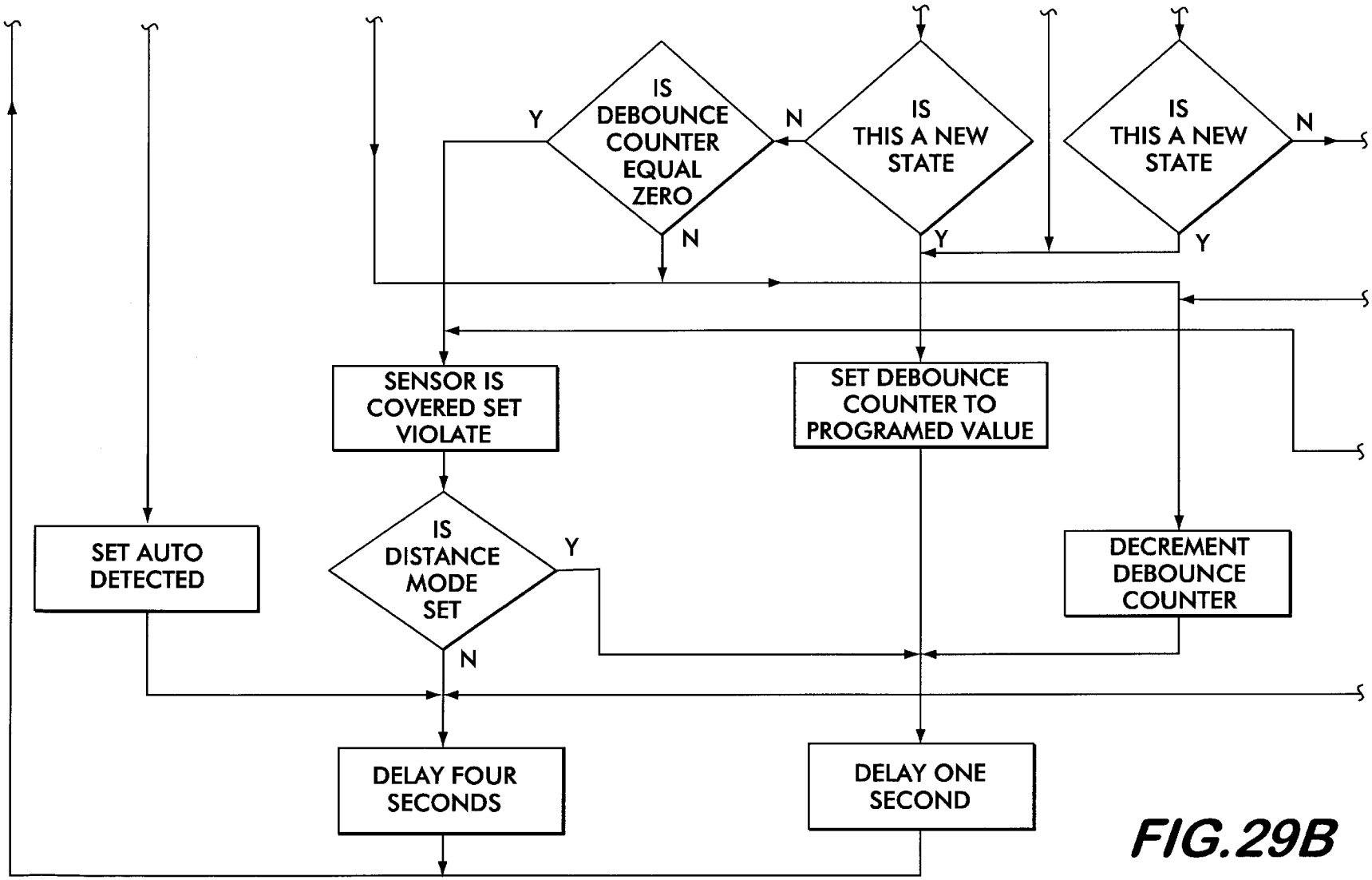
Figure 29C:
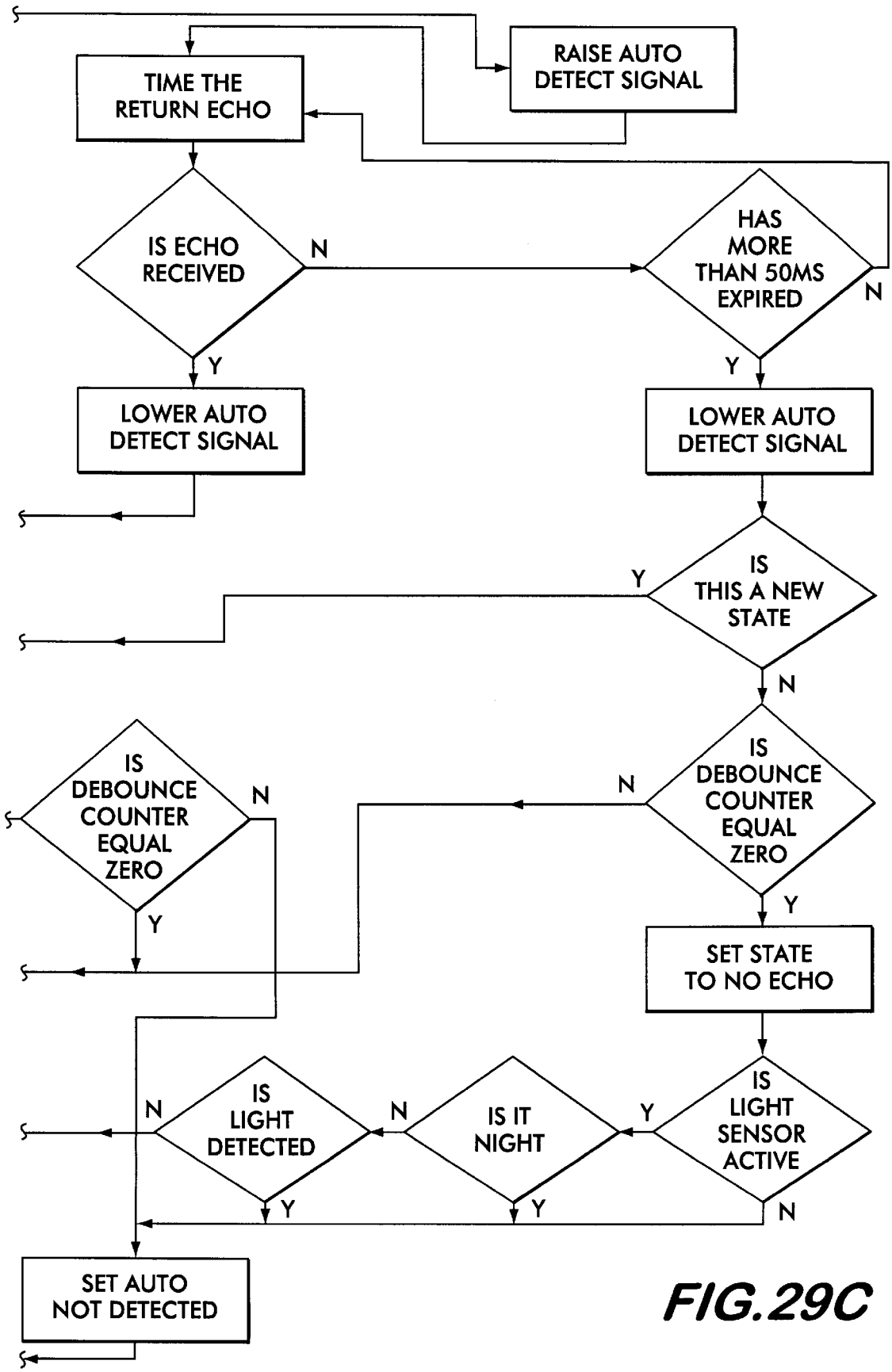

The card reader 276 is shown in FIG. 25. The payment card reader 276 can read payment cards such as debit cards and smart cards. A debit card (not shown) is a credit card size, plastic card that can be bought from the parking authority. The card initially has a predetermined number of parking hours stored on it. As discussed earlier, the electronic parking meter 220 has a slot 236 to insert the card. Each time the card is inserted, one parking unit is subtracted from the card and the appropriate time is displayed on the meter 220. The number of parking units still remaining on the debit card is also displayed. The smart card (also not shown) contains its own microprocessor. As such, the smart card can be used for a variety of purposes such as electronic parking meters 220, subway travel, train travel, etc. (which have their own respective card reading devices) because the smart card microprocessor can communicate with the card reading devices (e.g., payment card reader 276) when inserted and answer any queries put to it by the card reading devices. The smart card uses power from the card reading device that it is inserted to and, therefore, does not require its own power. The smart card also contains $E^2$PROM, thereby allowing the user to carry the smart card unenergized. Even credit cards can be utilized with the electronic parking meter 220 when combined with the RF transceiver 274, described earlier. The insertion of the credit card activates the RF transceiver 274 to wirelessly communicate with the appropriate crediting facility in order to verify the credit status of the inserted credit card before allowing time on the meter 220. Therefore, it is within the broadest scope of this invention to include an electronic parking meter 220 that can utilize a variety of payment cards such as debit cards, smart cards and credit cards.

FIG. 25 shows the board connector P3 for the card reader 276. Power to the card reader 276 logic is normally switched off. When a card is inserted in the debit card connector 259, the power is switched on and the data read from the debit card. The meter 220 decrements the data by one and writes it back to the debit card and time added to the meter 220. The data from the debit card is applied to pin 3 of P3 in FIG. 25, and sent to the microprocessor 268 as CR—DI on pin 25. Data out to the debit card is sent out of the microprocessor 268 pin 26 as CR/D—DO and is sent to the card reader pin 4 of P3. CRD—PRES is activated when a card is inserted into the debit card connector 259 and is sent to pin 44 of the microprocessor 268. CR—RESET comes from pin 30 of the microprocessor 268 and is applied to pin 6 of the card reader connector P3. The CR—RESET signal may be used to reset the card reader 276. SLAVE SELECT and CR/D—CLK are not used in this configuration. CR—POWEN is a signal from pin 32 of the microprocessor 268 and is used to turn on power to P3 pin 7 through Q27 and Q28.

FIGS. 26A and 26B depict the schematics of LCD driver 278 and the LCD connections. CR/D—CLK from pin 20 of the microprocessor 268 is applied to pin 8 of the LCD driver U22 and is used to clock data (CR/D—DO) into pin 9 of the LCD driver U22, to be displayed on the LCD 232. CR—POWEN from the microprocessor 268 pin 32 is transmitted to pin 10 of the LCD driver U22 and is used to enable the LCD driver 278 whenever the card reader 276 is not being powered. The signal LCD—C/D from the microprocessor 268 pin 31 is transmitted to the LCD driver U22 pin 11 on (FIG. 26A) is used to notify the LCD driver U22 whether the information on pin 9 is data or a command. The output lines from the LCD driver U22 go directly to the LCD 232 to light the segments of the digits.

The parking authority has a PC compatible computer (not shown). The data from all hand held computers are downloaded to this computer where the data is correlated in order to generate reports to all departments. With these reports, each department is better able to control cost and schedule personnel. For example, hard copy reports can be generated from the data provided by the electronic meters 220, including:

- revenue by day & day of week (revenue=cash, tokens, debit cards, separately)
- cash in meter (coins & tokens)
- activity by daypart & day of week
  - count & time space occupied (active & inactive separately)
  - count & time space empty (active & inactive separately)
  - count & time purchased (active & inactive separately)
  - count & time reset upon vehicle departure
  - count & time reset repurchased
  - count & time not reset reused
  - count & time in grace periods (arrival & expiration separately)
  - count & time expired
  - longest expired time by day, time stamped (at beginning or end of expiration)
- low battery warning flag
- count of unrecognized coins/tokens inserted
- count of valid/invalid coins/tokens in an attempt to feed meter
- count of valid/invalid coins/tokens inserted by hour (last 24 only)
- count of coins/tokens inserted in an attempt to feed the meter by hour (last 24 only)
- all revenue data will be in 3 byte fields
- all count data will be in two byte fields
- time data will be two byte hours, one byte minutes, one byte seconds.

The hand held computer has several uses. As stated earlier it can extract data from the parking meter and program the parking meter, but in the hands of the parking authority officer it has two additional functions. First, when a vehicle is parked at an expired meter 220, the meter 220 accumulates negative time until a ticket is given to the vehicle. When the parking enforcement officer issues, the officer then communicates with the meter 220, via the infrared transmitter in the officer's hand held computer, to indicate that a ticket was issued to the vehicle. When this happens, the meter 220 stops accumulating the negative time, but leaves the accumulated time on the meter 220 until the vehicle leaves. The total negative time for the meter 220 is reported in the statistical report and is an indication of the efficiency of the parking enforcement officer. A printer (not shown) may be attached to the hand held computer to print out the ticket and the ticket data can be stored in the hand held computer. This data can later be downloaded to the computer at headquarters.

A second additional use for the hand held computer is to search for scoff laws. For example, within the memory of the hand held computer, the top 500 scoff laws can be stored. As the parking enforcement officer is walking his/her beat, the officer enter in license plate numbers at random. If a license plate number matches a stored scoff law's license number, the parking enforcement officer can call for a boot or a tow truck. This allows for a much higher capture rate for scoff laws.

The operation of the electronic parking meter 220 is given in flow charts shown in FIGS. 28A–28C. The 8-character LCD display 232 displays the time remaining (i.e., paid for) in hours, minutes and seconds (e.g., "01:23:45")). By displaying the time remaining in seconds also, this discourages complaints by patrons that the meter 220 counts down remaining time too quickly; presently such complaints by patrons requires the parking authority to investigate the suspect meters by having to disconnect and disassemble the meters to verify if they actually count down too quickly. Therefore, by having the meter 220 display the remaining time in seconds the meter 220 can be easily verified for remaining time downcounting and also avoid costly disassembly and recalibration.

As discussed earlier, the warning LED 234 flashes whenever the 8-character LCD display 232 is flashing "EXPIRED". This flashing LED 232 allows a parking authority agent to quickly glance down a street to see if any of the meters 220 are in an expired condition. This minimizes the time the parking authority agent must walk down the entire street to determine whether each meter is in an expired state or not.

The display 232 is arranged to alternately display a first screen (hereinafter "main screen") and a second screen (hereinafter "alternate screen") The use of the term "negative time" is defined as time that a car is occupying a parking spot that has not been paid for by the parked car. The various display modes of the sidewalk side display 232, warning LED 234, the street side display 242 and the street-side LEDs 244A and 244B of the meter 220 are as follows.

The display 232 comprises a sleep mode and an active mode. During the sleep mode (e.g., at night), the display 232 displays a clock on the left side. During the active mode, the display 232 displays the following under the indicated, no-error conditions.

When no car is detected by the auto detector 266, the main screen displays an "EXPIRED" indication with "0" being displayed in the alternate screen on its right side. When a car is detected, a grace period may be programmed in that gives the patron a predetermined period, just after arrival in the spot, to gather coins, etc. This grace period is displayed by "EXPIRED" flashing once per second (no negative time is displayed and there is nothing being displayed in the alternate screen). The red LCD flasher 242 (on the street side 224) remains off during this period. When a car is detected and the predetermined grace period has expired, an "EXPIRED" indication begins flashing while alternating with negative time and the warning LED 234 flashes once every four seconds. The LCD 242 on the street side 224 of the meter 220 begins flashing red once per second and the LEDs 244A and 244B also begin flashing.

When money is inserted into the meter 220, the appropriate time is displayed. If the maximum time is being enforced and enough coins are inserted to reach the maximum time, a message "MAXIMUM BOUGHT" is flashed on the display 232 twice then the time remaining is displayed and counted down (in seconds, as discussed earlier). If more money is deposited before the vehicle is moved, the message ("MAXIMUM BOUGHT") is flashed on the display 232 twice, then the remaining time is displayed.

If time was purchased, but not the maximum time, and the time counts down to zero, the display 232 displays "EXPIRED" for a second grace period and can then be programmed without the red LED 234 or the red LCD 242 flashing. After the grace period, the display 232 shows "EXPIRED" with the negative time in the alternate screen and the red LED 234 and the red LCD 242 flash. If maximum time is being enforced, and the maximum time had been bought originally, there will be a message "MAXIMUM BOUGHT DO NOT INSERT COINS" alternating with the word "EXPIRED" and a negative time message.

Where money has been previously deposited into the meter 220, the display 232 displays the time remaining in hours, minutes and seconds. If money is deposited in the meter 220 while the meter is in the sleep mode, the appropriate time is displayed and counted down to zero. If the meter goes from awake to asleep or asleep to awake with time on the meter 220, the time counts down to zero and does not reset when the car leaves the parking spot.

If the vehicle leaves the parking space before the purchased time is depleted, the remaining time is removed from the display 232 and the indication "EXPIRED" flashes with "0" on the right side of the alternate screen.

Where certain error conditions occur, the meter 220 has the following operation.

If a car is in the parking spot but the car is not detected by the meter 220, and no money has been deposited in the meter 220 the display 232 shows "EXPIRED" with "0" on right side of alternate screen. Neither the red LED 234 nor the red LCD 242 flash under this condition. In this condition, the vehicle should get a ticket since no money was deposited, or time has run out.

If the auto detector 266 is disabled or broken and no money has been deposited in the parking meter 220, an "EXPIRED" indication flashes once per second with a "V" displayed on the right side of the alternate screen. If the red LED 234 was flashing before the sensor 74 was disabled, it remains flashing. The red LCD 242 on the street side 224 is solid red. In this condition, the vehicle should be ticketed since no money was deposited, or time has run out.

If a coin jam occurs, and there is no positive time displayed on the meter, the word "JAMMED" is displayed on the display 232 and the red LCD 242 on the street side 224 is solid red.

There is shown a second embodiment 300 of the electronic parking meter in FIG. 9 which includes a sensor spacer 302 that is disposed between the meter housing 226 and the vault 303 on the stanchion 6. The electronics of the electronic parking meter 300 is similar to the electronics described previously with respect to the electronic parking meter 200.

The spacer 302 comprises an outer wall 304 that conforms to the shape of the bottom of the housing 226 and the top of the meter vault 303. The interior 306 (FIG. 12) of the spacer 304 is substantially empty permitting an unobstructed path for coins processed by the coin processor 252 to pass through the spacer 302 and down into the vault 303. The function of the spacer 302 is to house the sonar transducer 74, thereby alleviating the need to contain the sonar transducer 74 in the housing 226. As can be seen in FIG. 9, the hole 10/mesh 12 is shown located within the spacer 302 rather than in the housing 28 as in the previously described electronic parking meter 220.

It should also be noted that a parking lot configuration of the electronic parking meter 300 is depicted in FIG. 9 since the sonar transducer opening 10 is shown on the same side as the coin insertion slot 236/card insertion slot 238. However, it is within the broadest scope of the present invention 300 that the spacer 302 can also be installed for a street-side operation such that the sonar transducer opening 10 is located on the opposite side (i.e., the street side) of the coin insertion slot 236/card insertion slot 238.

A third embodiment 400 of the electronic parking meter is shown in FIG. 10 which depicts the use of the electronic parking meter 300 with the sensor spacer 302 in conjunction with a rotator adaptor 402 on a double-headed meter platform 404. The double-headed meter platform 404 comprises a common vault 406 and a common cover plate 408. The rotator adaptor 402 permits parking authority personnel to rotate each of the electronic parking meters 300, coupled to the double-headed meter platform 404, about a respective longitudinal axis 405 in order to orient the respective sonar opening 10 to an optimum vehicle-detecting position. It should be noted that it is also within the broadest scope of the present invention that the rotator adaptor 402 can be used without the sensor spacer 302, as shown in FIGS. 15 and 16 where the electronic parking meters 220 are coupled to a double-headed meter platform 404 via rotator adaptors 402. Hence, reference to the axis 405 is applicable to the longitudinal axis of any of the various electronic parking meter embodiments.

Figure 11:
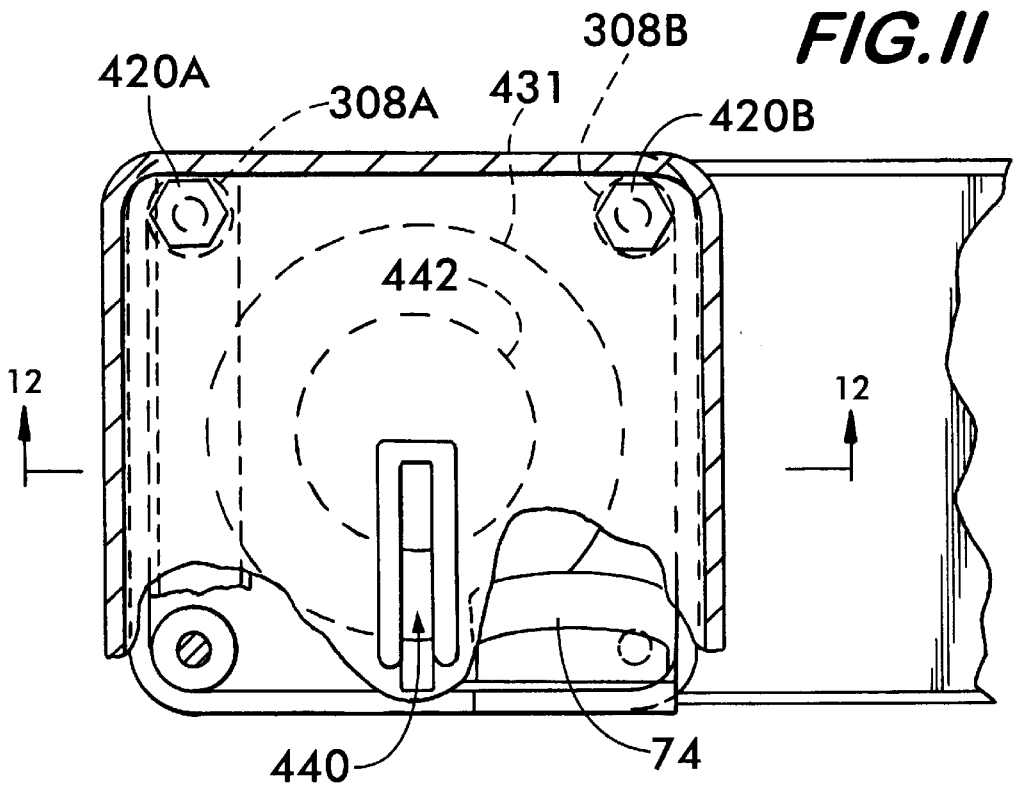
FIG. 11 is a top view in partial section of the rotator adaptor.
Figure 12:
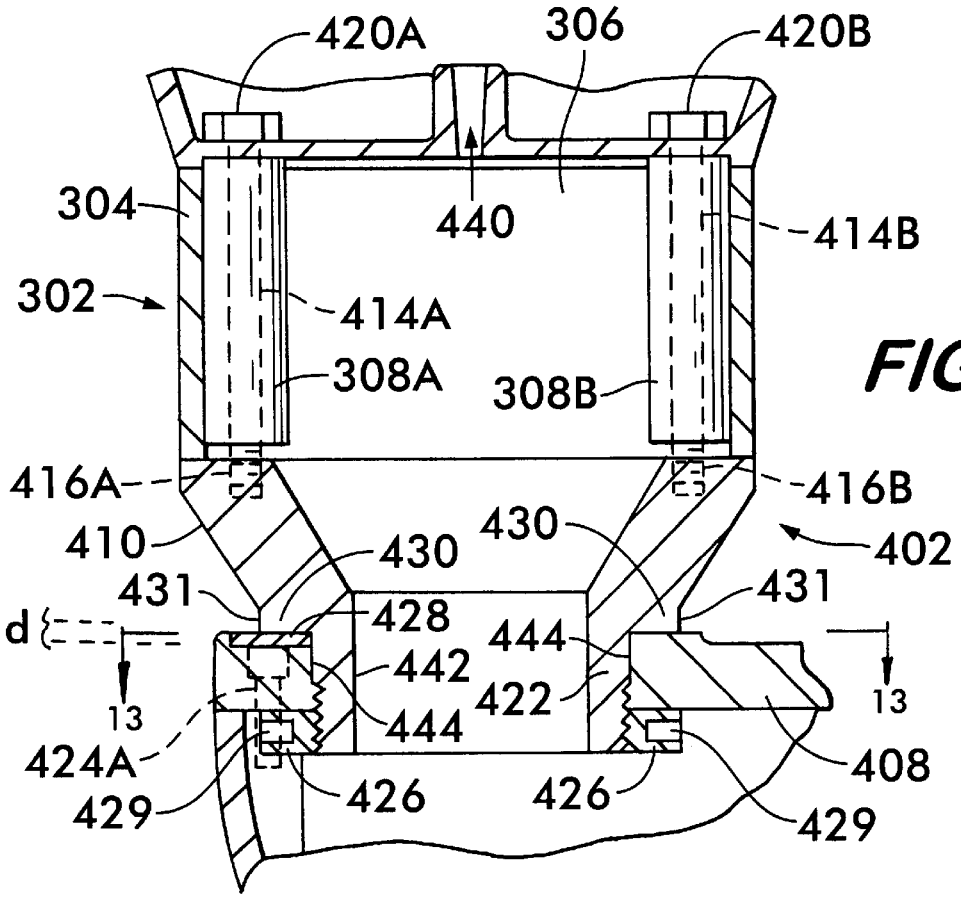
FIG. 12 is a view of the rotator adaptor taken along line 12—12 of FIG. 11.
Figure 18B:
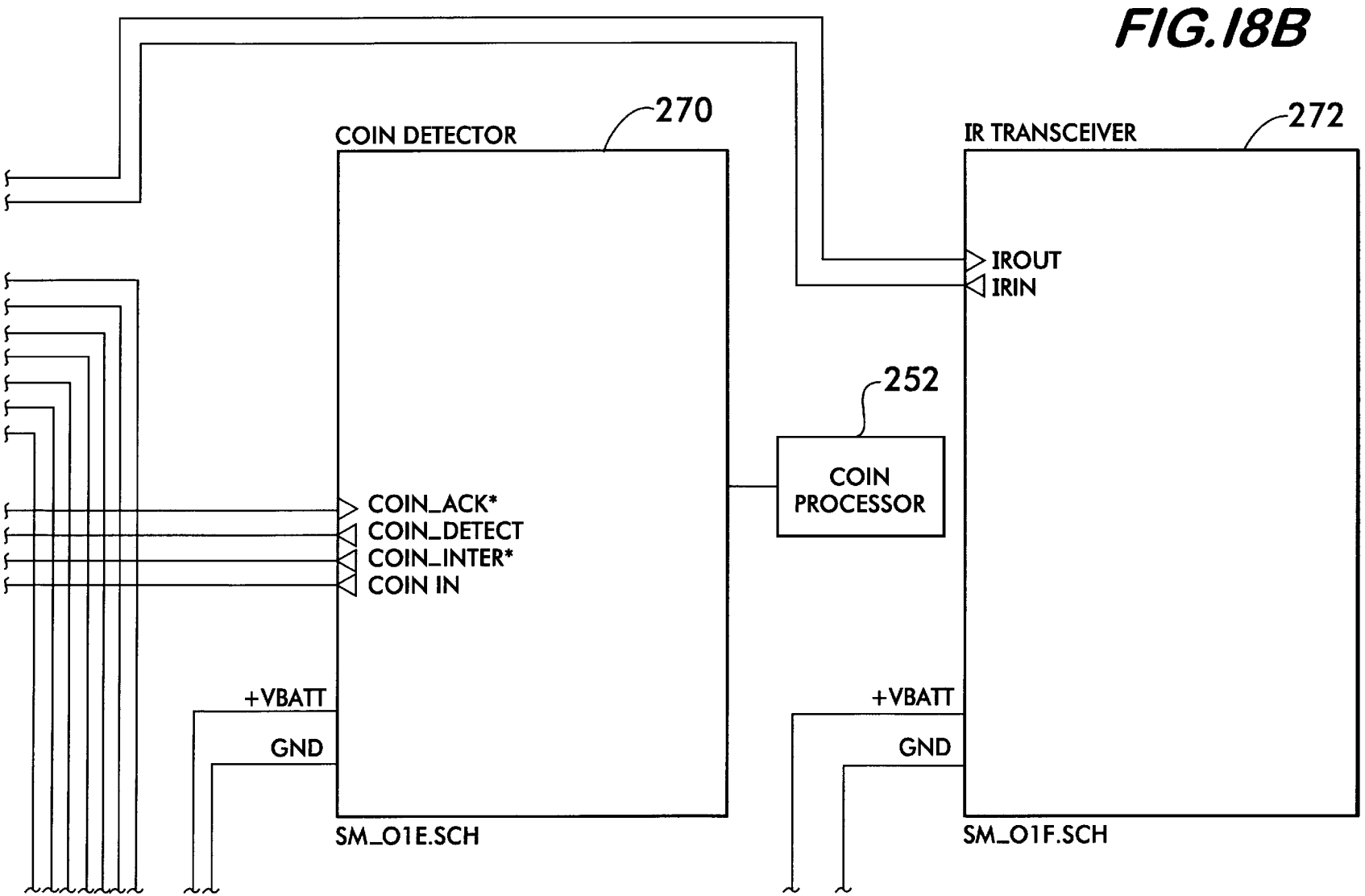
Figure 18C:
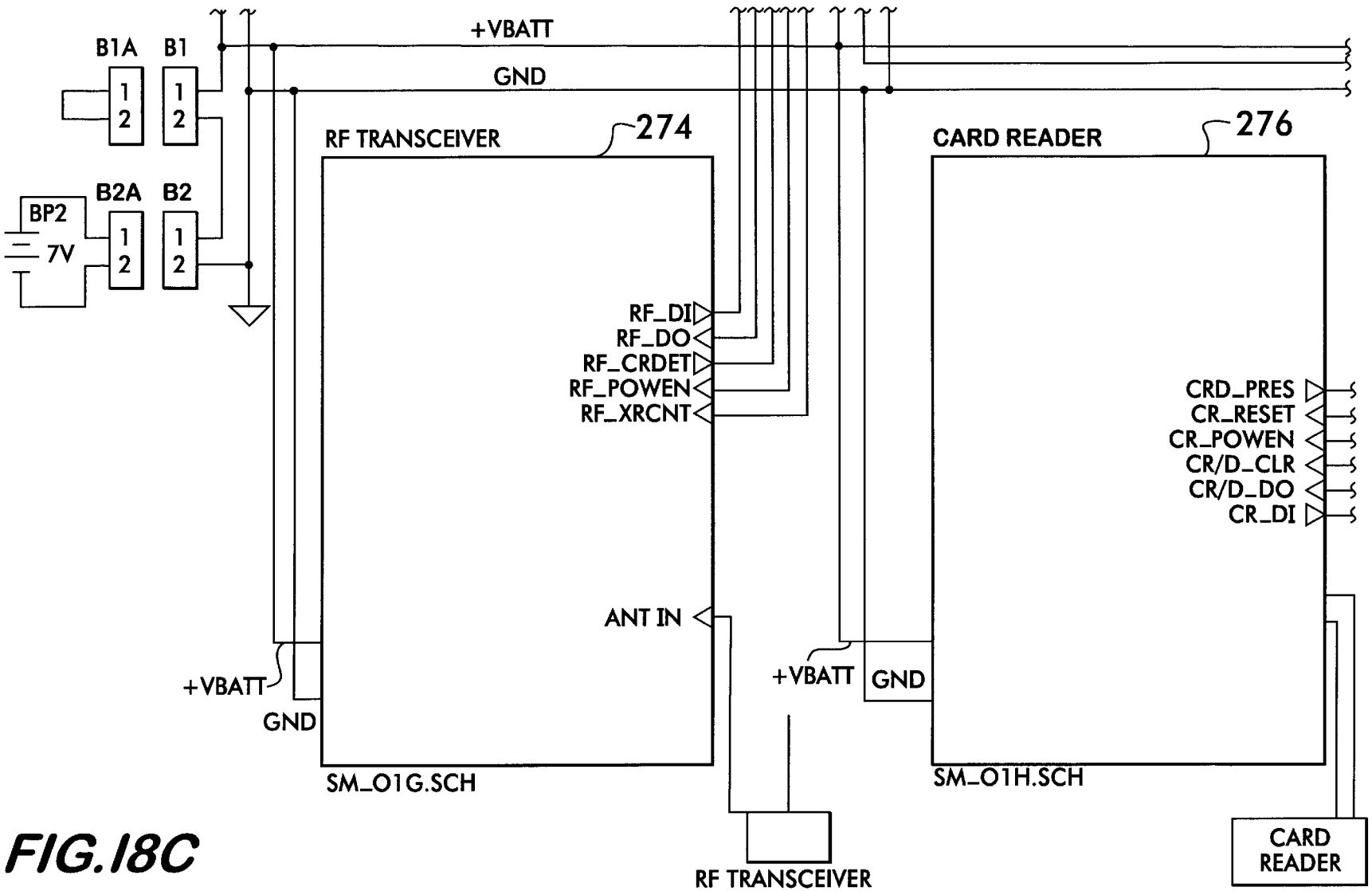
Figure 18D:
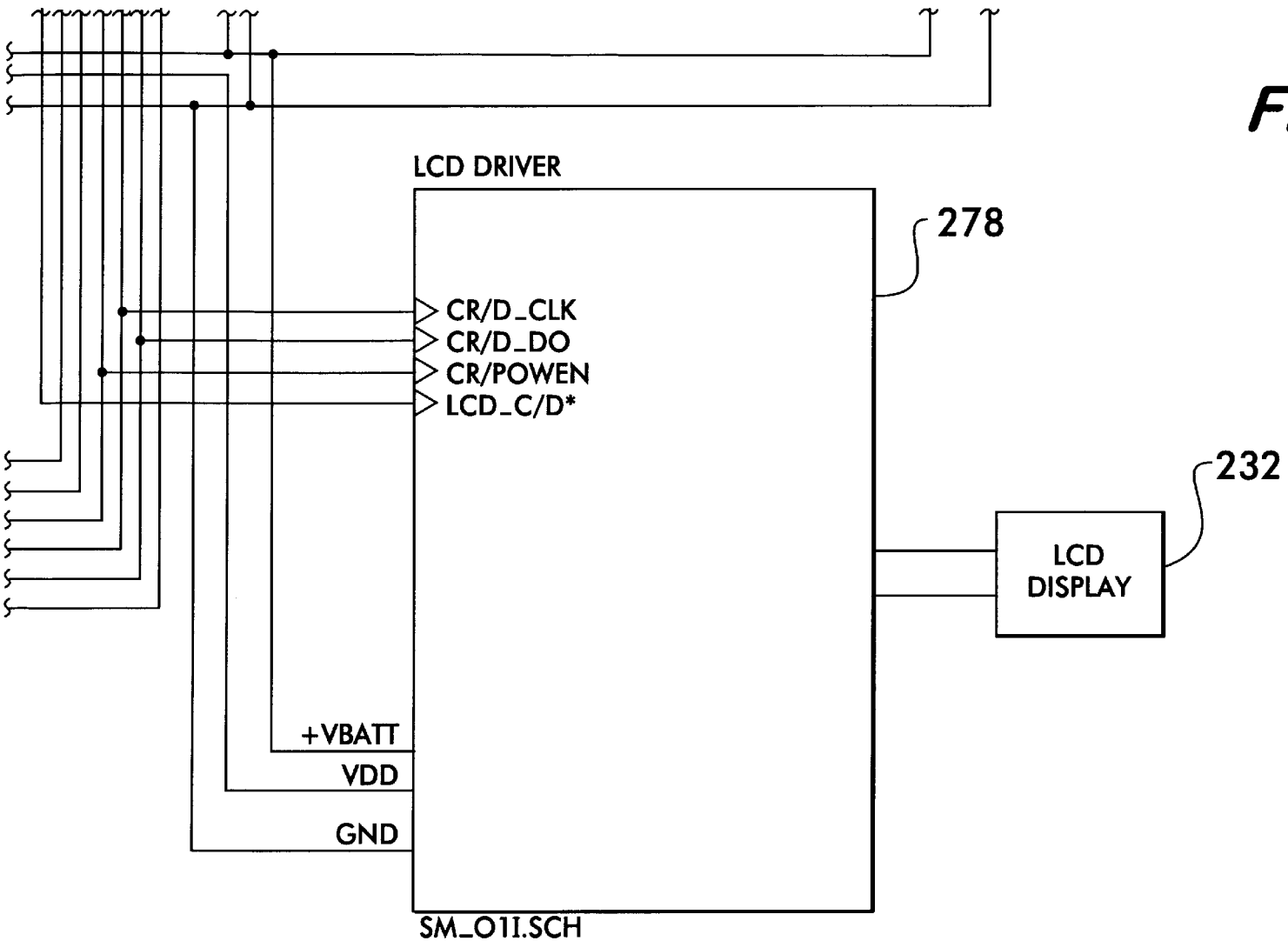

In particular, as shown in FIG. 12, the rotator adaptor 402 comprises a conical shaped part 410 having a rectangular head 412 that conforms to and abuts the bottom of the sensor spacer 302 via three bolts at each corner of the meter housing 228, sensor spacer 302 and rotator adapter head 412. Two bolts, 414A and 414B, are shown in FIG. 12 disposed in respective bolt sleeves 308A and 308B in the sensor spacer 302 as well as in threaded sleeves 416A and 416B in the rectangular head 412 of the rotator adaptor 402. The bolts secure the parking meter housing 226, the sensor spacer 302 and the rectangular head 412 together. As can also been seen in FIG. 12, the bolt heads (e.g., 420A and 420B) are contained inside the meter housing 226, thereby preventing any tampering from outside the meter 300. A fourth bolt is not used when the sensor spacer 302 is used since the sonar transducer 74 is disposed in the fourth corner 308 of the sensor spacer 302, as shown in FIG. 11. As stated earlier, it is within the broadest scope of the present invention to include the direct coupling of the meter housing 226 to the rectangular head 412 with no sensor spacer 302 disposed therebetween with shorter bolts being used to secure the housing 226 and the head 412 together; where the sensor spacer 302 is not used, a fourth bolt can be used in the fourth corner 310. Once the meter housing 226/sensor spacer 302/rotator adaptor 402 are secured together, the threaded neck 422 of the rotator adaptor 402 can be inserted through a hole in the cover plate 408 of the double-headed meter platform 404.

The conical design of the rotator adaptor 402 ensures that a coin that has already been processed by the meter 220 is directed downward into the common vault 406, after having passed through a coin housing slot 440 (FIGS. 11–12), and the spacer 302 (if present). The rotator adaptor 402 has inner wall 442 that forms the passageway for the coin; the threaded neck 422 has an outer surface 444.

The cover plate 408 is secured to the platform 404 by bolts at each corner (two of which, 409A and 409C, are shown in FIG. 13) of the cover plate 408; FIG. 13 shows two of these bolts, 424A and 424C, in phantom. As shown more clearly in FIG. 12, these cover plate bolts are countersunk in the cover plate 408 a distance "d". The importance of this countersink "d" is described below. A tamper proof member 428, as shown in FIG. 14, is then placed in the countersink "d" at each end of the cover plate to cover the bolts that secure the cover plate 408 to the platform 404. In particular, one of the tamper proof members 428 is shown disposed on top of the bolts 424A and 424C in FIG. 13. The tamper proof member 426 is of the thickness "d" as can be seen in FIG. 12. Securement of the tamper proof members 426 is discussed below.

With the threaded neck 422 of the rotator adaptor 402 passed down through the opening in the cover plate 408, a rotator adaptor ring 426 (shown in FIG. 13) can be rotated up onto the free end of the threaded neck 422; access to the free end of the threaded neck 422 is available by way of the vault 406 door (not shown) being opened during installation.

Before any further discussion of the rotator adaptor 302 and the double-headed meter platform 404 is made, it should be noted at this juncture, that any subsequent reference made to the electronic parking meter 220 is exemplary only and that any of the other electronic parking meter embodiments could be substituted therein.

The parking meter personnel then rotate each meter 220 to their respective optimum positions for detecting a vehicle in their respective parking spaces along the curb 425; FIG. 17 is a top view of the double-headed parking meter platform 404 with meters 220 showing how the meters 220 can be rotated about their respective axes 405.

Once the optimum position is found, the parking meter personnel secure that position by rotating the rotator adaptor ring 426 up the threaded neck 422 of the rotator adaptor 402. A spanner wrench (not shown) is used to engage one of a plurality of holes 429 as the ring 426 is rotated. The ring 426 is tightened against the bottom of the cover plate 408, thereby locking the parking meter 220 in the optimum position. In addition, a collar 430 having an outer surface 431 on the rotator adaptor 402, just above the threaded neck 422, traps the tamper proof member 428 within the countersunk "d", thereby preventing anyone from tampering with the bolts (e.g., 424A and 424C) which secures the cover plate 404 to the platform 404. The tamper proof member 428, being completely contained within the countersunk "d", cannot be moved linearly in any direction nor pried upward without first removing the rotator adaptor 402.

Once the meters rotator adaptor rings 426 are tightened, the parking meter personnel secure the vault door (not shown) and the double-headed meter platform 404 is ready for operation.

It should be further noted that the rotator adaptor 402 having a collar 430, the cover plate 408, the rotator adaptor ring 426, the countersunk cover plate bolts (e.g., 424A/424C) and the tamper proof member 430 can used with any conventional parking meter that can be mounted to the rotator adaptor 402 and that the above described invention is not limited to use with electronic parking meters.

Without further elaboration, the foregoing will so fully illustrate our invention that others may, by applying current or future knowledge, readily the same for use under various conditions of service.

We claim:

1. An electrical communication interface between an electronic parking meter and an external device wherein said electronic parking meter comprises a microprocessor and said external device comprises a vehicle detector, said communication interface being coupled between said microprocessor and said vehicle detector.

2. The electrical communication interface of claim 1 wherein said interface comprises a wire harness.

3. The electrical communication interface of claim 1 wherein said vehicle detector comprises a transducer assembly.

4. The electrical communication interface of claim 3 wherein said transducer assembly comprises a sonar transducer.

5. The electrical communication interface of claim 4 wherein said transducer assembly further comprises a phototransistor.

* * * * *